US008011394B2

(12) United States Patent
Luehrsen et al.

(10) Patent No.: US 8,011,394 B2
(45) **Date of Patent: *Sep. 6, 2011**

(54) METHODOLOGY AND APPARATUS FOR STORING AND DISPENSING LIQUID COMPONENTS TO CREATE CUSTOM FORMULATIONS

(75) Inventors: Robert A. Luehrsen, Libertyville, IL (US); John Borkovec, Riverside, IL (US); Derek P. Pedraza, Ingleside, IL (US)

(73) Assignee: GFI Innovations, Inc., Gurnee, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/874,968

(22) Filed: Sep. 2, 2010

(65) Prior Publication Data

US 2011/0017773 A1 Jan. 27, 2011

Related U.S. Application Data

(60) Continuation of application No. 12/470,102, filed on May 21, 2009, now Pat. No. 7,789,111, which is a division of application No. 11/248,064, filed on Oct. 12, 2005, now abandoned, which is a continuation-in-part of application No. 10/628,320, filed on Jul. 28, 2003, now Pat. No. 7,198,073.

(60) Provisional application No. 60/456,746, filed on Mar. 21, 2003, provisional application No. 60/640,000, filed on Dec. 29, 2004, provisional application No. 60/640,001, filed on Dec. 29, 2004.

(51) Int. Cl.
*B65B 1/04* (2006.01)
*B65B 3/04* (2006.01)

(52) U.S. Cl. ..... 141/83; 141/9; 141/95; 141/104; 222/77; 222/144

(58) Field of Classification Search ..... 141/9, 83, 141/94, 95, 100, 104, 105; 222/77, 144
See application file for complete search history.

(56) References Cited

U.S. PATENT DOCUMENTS 2,684,008 A 7/1954 Vonnegut (Continued)

FOREIGN PATENT DOCUMENTS

DE 10239595 3/2004

(Continued)

OTHER PUBLICATIONS

Komori K-North, Inc. : "Sentinel Ink Management System"; Komoir Lithrone S 40 at K.North, Inc. Ontario & Western Canada; Komori Printing Press Sales and Services [Retrieved on Feb. 2, 2009] Retrieved from the internet: http://www.k-north.ca/pages/product_ss_ink.html.

(Continued)

*Primary Examiner* — Gregory L Huson
*Assistant Examiner* — Nicolas A Arnett
(74) *Attorney, Agent, or Firm* — Banner & Witcoff, Ltd.

(57) ABSTRACT

The invention includes a material dispenser that further includes a container containing material, a press plate or puck for exerting pressure on the material, a sensor for detecting the material discharged from the container, and a scale for detecting the amount of material discharged from the container. The sensor and scale provide feedback to a computer which controls the amount of pressure exerted on the material. The computer controls the pulsing of additional material from the container until a targeted amount of material has been discharged from the container. The invention permits the dispensing of a specific amount of material in a controllable, metered fashion.

25 Claims, 14 Drawing Sheets

U.S. PATENT DOCUMENTS

| | | | |
|---|---|---|---|
| 2,787,402 | A | 4/1957 | Stiner et al. |
| 2,848,019 | A | 8/1958 | Corbin et al. |
| 3,534,520 | A | 10/1970 | Moran |
| 3,874,430 | A | 4/1975 | Lansdale |
| 4,065,032 | A | 12/1977 | Lydiksen |
| 4,096,972 | A | 6/1978 | Bartels et al. |
| 4,193,513 | A | 3/1980 | Bull, Jr. |
| 4,231,492 | A | 11/1980 | Rios |
| 4,280,637 | A | 7/1981 | Runciman |
| 4,335,759 | A | 6/1982 | Pattiniemi et al. |
| 4,356,935 | A | 11/1982 | Kamin |
| 4,796,788 | A | 1/1989 | Bond |
| 4,913,322 | A | 4/1990 | Stoffler et al. |
| 4,928,853 | A | 5/1990 | Isham et al. |
| 4,967,938 | A | 11/1990 | Hellenberg |
| 5,083,591 | A | 1/1992 | Edwards et al. |
| 5,129,551 | A | 7/1992 | Gott |
| 5,163,484 | A | 11/1992 | Howlett et al. |
| 5,213,236 | A | 5/1993 | Brown et al. |
| 5,246,674 | A | 9/1993 | Katschnig et al. |
| 5,339,995 | A | 8/1994 | Brown et al. |
| 5,423,216 | A | 6/1995 | Kitamura et al. |
| 5,439,143 | A | 8/1995 | Brown et al. |
| 5,493,840 | A | 2/1996 | Cane |
| 5,559,339 | A | 9/1996 | Domanik et al. |
| 5,588,472 | A | 12/1996 | Johnson |
| 5,904,334 | A | 5/1999 | Grunert et al. |
| 5,961,007 | A | 10/1999 | Dornbusch et al. |
| 6,056,158 | A | 5/2000 | Rossetti et al. |
| 6,131,766 | A | 10/2000 | King et al. |
| 6,286,566 | B1 | 9/2001 | Cline et al. |
| 6,397,745 | B2 | 6/2002 | Koehler |
| 6,405,901 | B1 | 6/2002 | Schantz et al. |
| 6,412,658 | B1 | 7/2002 | Bartholomew et al. |
| 6,637,471 | B2 | 10/2003 | Luehrsen et al. |
| 6,701,977 | B2 | 3/2004 | Taylor et al. |
| 6,776,199 | B2 | 8/2004 | Crivellaro et al. |
| 6,899,028 | B2 * | 5/2005 | Arai et al. ..... 220/659 |
| 6,921,000 | B2 | 7/2005 | Wagner et al. |
| 6,957,672 | B2 | 10/2005 | Taylor et al. |
| 6,959,284 | B1 | 10/2005 | Howes |
| 6,991,004 | B2 | 1/2006 | Kaufhold et al. |
| 7,082,970 | B2 | 8/2006 | Bartholomew et al. |
| 7,099,740 | B2 | 8/2006 | Bartholomew et al. |
| 7,121,429 | B2 | 10/2006 | Bartholomew et al. |
| 7,134,573 | B2 | 11/2006 | Post |
| 7,198,073 | B2 * | 4/2007 | Luehrsen et al. ..... 141/94 |
| 7,347,344 | B2 | 3/2008 | Engels et al. |
| 7,360,564 | B2 | 4/2008 | Engels et al. |
| 7,475,710 | B2 | 1/2009 | Bartholomew et al. |
| 7,571,122 | B2 | 8/2009 | Howes |
| 7,789,111 | B2 * | 9/2010 | Luehrsen et al. ..... 141/83 |
| 2003/0019537 | A1 | 1/2003 | Taylor et al. |
| 2004/0149776 | A1 | 8/2004 | Feygin et al. |

FOREIGN PATENT DOCUMENTS

| | | |
|---|---|---|
| EP | 0391286 | 10/1990 |
| EP | 1260435 | 11/2002 |

OTHER PUBLICATIONS

"Sentinel Ink Management System" [Retrieved on Feb. 2, 2009] Retrieved from the Internet: http://www.ebzour.co.il/html/ebz/accel/ink/sentinel.htm.

"Litho Printer Reduces Ink Waste With Innovative Sheetfed Ink Pumping System"; By: Gary A. Jones; Printers' National Environmental Assistance Center (PNEAC); pp. 1-4; Sep. 2004; Retrieved from the Internet: http://www.pneac.org/sheets/pdfs/JohnRobertsPrintingCaseStudy.pdf.

* cited by examiner

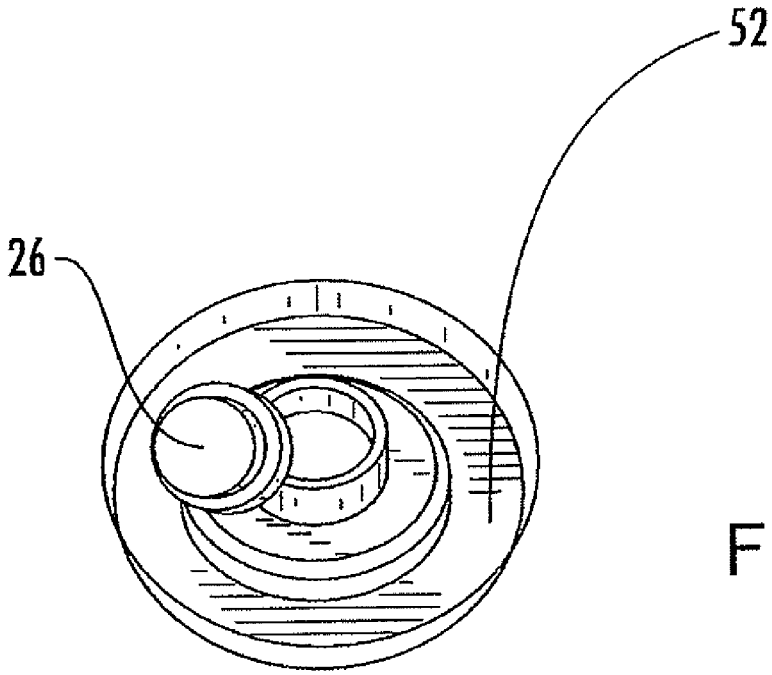
FIG. 6
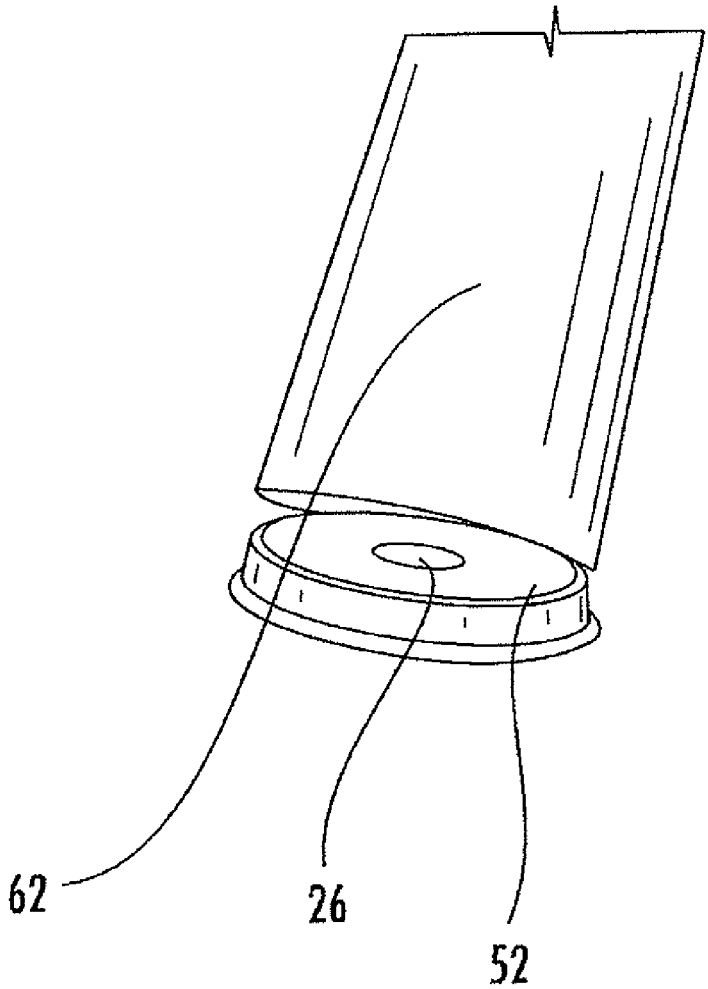

METHODOLOGY AND APPARATUS FOR STORING AND DISPENSING LIQUID COMPONENTS TO CREATE CUSTOM FORMULATIONS

CROSS-REFERENCE TO RELATED APPLICATIONS

This application is a continuation of U.S. application Ser. No. 12/470,102, filed May 19, 2009, which is a divisional of U.S. application Ser. No. 11/248,064, filed Oct. 12, 2005, which is a continuation-in-part of U.S. application Ser. No. 10/628,320, filed Jul. 28, 2003, now U.S. Pat. No. 7,198,073, which claims priority to U.S. Provisional Application Ser. No. 60/456,746, filed Mar. 21, 2003. U.S. application Ser. No. 11/248,064 also claims priority to U.S. Provisional Application Ser. No. 60/640,000, filed Dec. 29, 2004 and U.S. Provisional Application Ser. No. 60/640,001, filed Dec. 29, 2004.

FIELD OF THE INVENTION

The present invention relates to dispensing a specific amount of material from one container into another container.

BACKGROUND OF THE INVENTION

There are many different types of material dispensers available to the market offering differing levels of automation. Choosing one type of dispenser over another is often a function of what type of material is needing to be dispensed and is further defined by the ability of the material being dispensed to flow (as in the case of a liquid—typically referred to as the materials' viscosity) or change its form (as in the case of a powder) when relieved of a means of containing such material in a cylindrical shape. A machine dispensing material low in viscosity would likely be different in both methodology and apparatus from that of a machine dispensing a more viscous paste-type material.

For purposes of background and by way of illustration, references will be made to common practices found in the ink industry because such practices fairly represent the practices found in other industries requiring the use of accurately dispensing a specific amount of material from one container to another. It should be understood that the various aspects and teachings of the inventions described herein are not limited in their application and are not limited to the ink industry. Indeed, the various aspects, teachings, embodiments and methodologies described herein have application in all industries and in all systems and processes where it is desirable to dispense a specific amount of material from one container to another.

As is known, materials are typically stored and transported by using a number of different containers. Among the most common are steel drums (55 and 30 gallon capacities), HDPE buckets (5, 3½, 2 and 1 gallon capacities), and HDPE jugs (1 gallon capacity). Other containers include cardboard-roll or plastic cylindrical tubes (5", 3¾" and 2" tubes). The 5" and 3¾" tubes are typically known in the ink industry as being either HDPE or cardboard-roll tubes and commonly referred to as Sonoco™ or Ritter cartridges. These tubes typically hold 4.4 or 8 lbs of material. The 2" tubes are typically known in the construction industry as being either HDPE or cardboard-roll tubes and commonly are referred to as caulk tubes that typically hold either 10 ounces or 1 quart of material. Still other known containers include metal cans of 1 and 2 quart capacities. These cans may be made of metal or have a cardboard-roll body that typically hold 1 quart of tint (or colorant) as seen in the paint industry. Still other containers include bags made from a substantially air-tight, flexible, compressible composite material.

Dispensing equipment is seen in virtually every industry requiring a finished product that is created from a formulation. Formulations are often seen in the paint, ink, cosmetics, pharmaceutical, foodservice and chemicals industries. For example, in the ink industry, a printer may need to have a custom color of ink created to satisfy the requirements of a particular project. The custom color of ink is created using a formulation, or a recipe of materials. This combination of pre-determined amounts of specific ingredients is also used in the paint industry, for example, to create a custom color of paint and in the cosmetics industry to create a custom color of facial cream or makeup base.

A current manual method for creating a custom color from a formulation in the ink industry is for the operator to manually transfer one of the formulation components from one container (such as, a 55 gallon drum, 5 or 3½, 2 or 1 gallon (plastic) bucket, or an 8 lb. metal can) into another container, which sits on a precision scale, until the operator adds enough material into the container on the scale to reach the required amount of material called-out in the formulation for that finished product. The operator repeats the process with every component required of the formulation until the operator has "weighed-up" each ingredient. Throughout the process of "weighing-up," the operator may need to manually add to or deduct from the amount of material placed into the finished product container that sits on the scale in order to attain the target value stated for each component in the formulation. This manual method of creating finished products from a formulation through the use of a container on a scale is referred to as the "Smart Scale" or "Hand Mix" method in a number of industries (hereinafter "Manual Mix Method").

Another current method for creating a finished product from a formulation is through the use of a dispenser that may have a number of reservoir containers, each of which would contain one of the components required to create a finished product. The component is moved from the reservoir container, through the use of a pumping device connected to the reservoir container, through a length of piping to a dispensing valve that, upon receiving feedback from a computer's controlling software (which receives feedback from a scale that the receiving container sits upon), terminates the flow of material (at a value close to the target amount) and deposits the material into a receiving container. The dispensing valve would need to repeatedly open and close upon feedback from the computer and scale in order to dispense small amounts of a component to reach the target amount. The pumps subsequently would need to push the component through the dispensing valve, which may be rapidly opening and closing. The aforementioned pumping devices typically are piston, positive displacement, gear, diaphragm or peristaltic type pumps that force the material through the piping. Each of the aforementioned pumping device types are best suited for specific applications that relate to, among other things, the viscosity of the material being moved, the volume at which the material is required to pass through it and the level of accuracy required of the pumping device for the application. The aforementioned dispensing valve may be a ball, globe, piston, diaphragm, plug or butterfly type. Each of the aforementioned dispensing valve types are best suited for specific applications that relate to, among other things, the viscosity of the material being moved, the volume at which the material is required to pass through it and the level of accuracy required of the dispensing valve for the application. This automated method of creating finished products from a formulation is often referred to as "Automated Pump Dispensers" method in a number of industries (hereinafter "Gravimetric/Pump Dispenser Method").

Yet another current type of automated material dispenser uses a number of reservoir containers, each of which contains one of possible components required of any finished formulation and dispenses those components through a volumetric means as opposed to the aforementioned Gravimetric means. The volumetric method (hereinafter "Volumetric Dispensing Method") uses a positive displacement means of dispensing where a cylinder, filled with a material component, is emptied of some portion of the material (that resides within it) through the use of a piston found within it (located between the material component and the discharge end of the cylinder) that moves a predetermined distance and displaces a predetermined amount of the material component. This Volumetric Dispensing Method assumes that when the piston moves a predetermined distance that the amount of material component dispensed is the same time after time.

Drawbacks and disadvantages exist with respect to the Manual Method of dispensing formulations. For example, operator handling is the most costly expense of creating custom formulations when using the Manual Mix Method. In the ink industry, for instance, 55 gallon steel drums, 5 and 3½ gallon plastic buckets and 5 lb. and 8 lb. tin buckets are the most common container types used for storage and delivery of ink, whether the material is a base component used to create a finished product or is finished ink. The operator must manually remove the component from the container through the use of a spoon or putty knife type of tool. Paste-type ink, for instance, can be extremely dense and highly viscous (4,000-40,000 cps (centipoise) where water=1 cps; honey=5,000 cps). Paste-type ink's "stringing" characteristics (the ability for the material to adhere to itself, even when attempting to be separated) are high. The process of scooping the material from the buckets is physically taxing on the operator and can be a very messy operation due to the stringing nature of the material.

In addition, the accuracy of creating a formulation using the Manual Method is a function of the resolution of the scale (how accurate the scale is (measured in a percentage of the scale's full capacity)) and of operator skill in being able to apply the appropriate amount of material needed for any given formulation. If the material is highly viscous the operator can more easily remove material from the amount added (if the amount added were too high) than if the material were less viscous in which case the material added may disperse into the material already in the receiving container, not allowing for removal of the amount over added. If too much of a given material of the formulation is manually added, additional amounts of the other components required of the formulation would proportionally need to be added, resulting in the creation of more finished product than originally requested, potentially resulting in material waste.

Similarly, there are some drawbacks and disadvantages with the Gravimetric/Pump Dispenser Method. Some of the major drawbacks experienced with this method are dispense valve actuation, dispensing time, accurate reporting, scale cost, effect of vibration and wind currents, pump wear and cost, air fluctuation, and multiple scale cost. More specifically, and by way of example, the dispense valve opens via an electric/pneumatic solenoid valve which is controlled by a Human Machine Interface (HMI) which is the layer or device that separates a human that is operating the machine from the machine itself and, in some instances, is a computer. The HMI either communicates directly with or sends signals to other devices, for example, a program logic controller (PLC) which ultimately provides control of all electrical, pneumatic and mechanical movements and actions of the machine. The HMI sends a signal to a pneumatic solenoid that then in turn sends a pneumatic (air) signal that must physically travel through an air line in order to open and/or close the dispense valve. The delay created in an air signal needing to travel through an air line to the pneumatic solenoid affects how fast the dispense valve can physically open and close. The process of the dispense valve opening and closing in order to accurately dispense a small amount of material is commonly referred to as being in "pulse mode." Any delay of the air signal traveling through the air line will ultimately affect how long the dispense valve remains in the pulse mode. If the target weight amount is less than or equal to 0.1 grams, the importance of the dispense valve not remaining in the pulse mode becomes critical.

Another drawback involves time delays in dispensing materials. The multiple dispensing valves may need to move in and out of position to accommodate any given material needing to be dispensed. There are time added delays due to the scale needing to completely stop its movement after each dispense in order that the computer can activate the pump to dispense more product, if required. The overall formulation dispense time may therefore increase because of required accuracy or number of components. As the dispense valve opens and closes, some amount of residual liquids, in the form of a drop, can remain on the edge of the dispense valve. When the scale signals the computer that the target value has been reached the computer closes the dispense valve. The residual material can fall into the final receiving container due to gravity. The computer receives a signal that the dispense is complete and does not account for any residual material that may fall into the final dispense container. To resolve this inherent problem, some manufacturers of Gravimetric/Pump Dispensers may have their software "lock-in" the target value for reporting purposes, when in fact the actual dispensed amount may be different.

Yet another disadvantage with Gravimetric/Pump Dispensers relates to the costs of the scales needed with those systems. The scales may vary in cost between $1,500 and $10,000 per scale. Some Gravimetric/Pump Dispensers may use several scales of varying capacities that add significantly to the cost of the Gravimetric/Pump Dispenser.

In addition, scales can be susceptible to vibration and air movement due to their sensitive load cells. Scales used for dispensers are often set to read as accurately as possible. Air movement over the scale or vibration under the scale may cause the scale to interpret the movement as additional weight and relay the information to the computer. The computer may interpret that the dispense valve has added more material to the final dispense when in fact it has not. The computer, therefore, must give the scale time to stabilize before adding more product. This problem could cause time delays and inaccurate readings of the actual dispense if the scale is not shrouded by a cover.

Yet another drawback involves the pumps used with the Gravimetric/Pump Dispensers. These pumps are used to transfer material from the reservoir containers to the dispense valves. A costly pump is required for each material component. The pumps add considerable upfront expense and ongoing maintenance expenses to the system. The cost of maintenance is high due to the fact that the pumps, being mechanical devices, inherently are subject to a high degree of wear and tear. Failure of the seals that provide the pumping ability is the most common maintenance issue with pumps. The pumping system relies on compressed air supplied by the end user of the Gravimetric/Pump Dispensers. Air compressors struggle with the delivery of consistent air pressure which the dispense valve relies on to accurately dispense to the scale. If there is too much fluctuation in delivered air pressure (15-20 psi) the calibration values set in the computer may "over dispense" or "under dispense."

Moreover, there are disadvantages and drawbacks related to the transportation, storage and disposal of known material containers. For instance, there can be high costs relating to residual waste of material in a container when the material in the container is used and the container is disposed of. Waste is also due to the material curing prior to its intended end use when, in the container, it may develop a film (often referred to as "skinning") when exposed to certain environmental conditions. The operator may dispose of the container even though it may still have a substantial amount of material remaining in it.

Throughout the course of using any material stored in a bucket container, the bucket's lid may be removed and replaced a multiple number of times, depending on the volume requirement of that particular material for any given formulation. If all of the material in the bucket is not used when the lid is first removed, and the lid is repeatedly removed and replaced, over the course of time the material in the bucket, especially that material that may not have been sufficiently removed from the side walls of the bucket, tends to skin-over or may become crusty, rendering it useless and adding to the amount of wasted material. Occasionally, the dried or contaminated material on the sidewalls contaminates the remaining "good" material in the bottom of the bucket, rendering the good material difficult to work with, making it more subject to operator disposal. Additionally, on the bottom of a bucket, due to the bucket's construction, areas could be present where ink becomes trapped and the complete removal of the ink from the bucket becomes virtually impossible.

Similarly, throughout the course of using any material stored in a HDPE jug container, the HDPE jug container's cap may be removed and replaced a multiple number of times, depending on the volume requirement of that particular material for any given formulation. If all of the material in the HDPE jug container is not used when the cap is first removed, and the cap is repeatedly removed and replaced, over the course of time the material in the HDPE jug container, especially that material that may not have been sufficiently removed from the side walls of the HDPE jug container, tends to skin-over or may become crusty, rendering it useless and adding to the amount of wasted material. Occasionally, the dried or contaminated material on the sidewalls of the HDPE jug container contaminates the remaining "good" material in the bottom of the HDPE jug container, rendering the good material difficult to work with, making it more subject to operator disposal. Additionally, on the bottom and on the sidewalls of an HDPE jug container, due to the HDPE jug container construction and the small opening, areas could be present where ink becomes trapped and the complete removal of the ink from the HDPE jug container becomes virtually impossible.

Additionally, there are drawbacks with respect to known cardboard-roll or plastic tubes that result in material waste in those containers. The known tubes use a movable displacing "puck" that, when pressed downwards towards the bottom of the tube, acts as a plunger to press the material residing in the tube out of the orifice found on the bottom of the tube. However, with known tube designs, an area remains between the puck and the fixed end of the tube, creating a region for the material in the tube to remain and not be discharged thus creating waste when the tube is disposed of.

Other drawbacks and disadvantages exist with respect to known dispensers, material containers and dispensing methods that are overcome by the present inventions described herein.

SUMMARY OF THE INVENTION

The present invention looks to improve on the methodology and apparatus in which materials are dispensed in order to create a desired finished product based on a prescribed mixture of a number of material components typically divided according to their individual requirements by percentages. The present invention additionally looks to improve upon the container in which the material is stored, shipped and used. The present invention also looks to integrate an improved material storage/shipping/dispensing container that may contain a pressure responsive silicone dispense valve configured to allow the dispensing of a specific amount of material through it in a controllable, metered fashion.

The present invention includes numerous methodologies and numerous apparatuses for dispensing materials. In one exemplary embodiment, the invention includes a dispenser that includes a plurality of integral material reservoir cylinders (each of which may or may not contain a separate material bag in which resides a component required for a formulation), or a plurality of alternate material reservoir containers (such as drums that are detached from and are not part of the dispenser but that supply material to the dispenser, with a component required for a formulation residing in each drum), or a combination of both a plurality of integral material reservoir cylinders and a plurality of alternate material reservoir containers, that provides a volume of material through a supply tube into a valve that directs the material to either: 1) a dispense tube and through a dispense valve, through or past a material sensor then into a receiving container that sits upon a scale, or 2) into a dispense cylinder in which resides a piston that, through the use of a piston drive plate actuator and the piston drive plate actuators' piston drive plate, moves the piston and directs the material through a valve which directs the material through a dispense tube, through or past a sensor and in-turn through a dispense valve and into a receiving container that sits upon a scale.

Another exemplary embodiment of the invention is a dispenser that includes a rotary table that holds one or a plurality of material containers on the rotary table. Within each material container resides a single base material which, if required of a desired formulation, in some calculated proportion, is used. In an exemplary application, a rotary table motor rotates the rotary table and positions the material container required by the formulation to the dispense position, which is the area towards the front of the dispenser and under a pressure actuator. The dispenser also includes an HMI, a scale and a feedback sensor. In one method of use, the operator inputs into the HMI a value of the desired finished amount ("target amount" in a value of total weight) of a custom formulation to blend. The HMI calculates the total weight of each of the base material components required ("calculated amount") to create the target amount. The pressure actuator applies downward pressure on a movable member, such as a puck (residing within the material container used to push the base material out of the container) which pushes the base material through a proportional pressure responsive dispense valve that opens and closes in a rolling manner into a receiving container residing on a scale. As the base material is expelled through the valve, the base material is sensed by a sensor which, along with the scale, sends feedback information to the HMI to increase, decrease or discontinue the pressure being applied to the puck in the material container by the pressure actuator to provide the calculated amount. If the amount of base material expelled does not equal the calculated amount the HMI recalculates the amount of base material required (the "recalculated amount"), recalculates the amount of pressure required of the pressure actuator to attain the recalculated amount, and sends a signal to the pressure actuator to expel the recalculated amount of base material from the material container. The process of expelling a base amount, receiving feedback from the sensor and the scale, calculating if more base material is required and, if required, recalculating the amount of pressure required of the pressure actuator to attain the total recalculated amount continues until the calculated amount is attained. When the calculated amount is attained the HMI positions the next material container required of the formulation, if another is required, into a position under the pressure actuator and repeats the process until the calculated amount of each base material components of the required formulation have been dispensed into the receiving container.

Another embodiment of the dispenser holds one or a plurality of containers in a linear configuration and, within each resides a single base material which, if required of a desired formulation, in some calculated proportion, is used. As above, each material container can be positioned under a pressure actuator. However, with this embodiment, the containers are moved under the pressure actuator, or the pressure actuator is moved over the containers in a linear manner, as opposed to the above-described rotary manner. The dispenser may also include an HMI, a scale and a feedback sensor. The method of use may be similar to the method described above with respect to the rotary table configuration, and will not be repeated here.

Yet another exemplary embodiment of the dispenser holds one or a plurality of containers in either a linear configuration (through the use of a linear slide) or a rotary configuration (through the use of a rotary table) and, within each resides a single base material which, if required of a desired formulation, in some calculated proportion, is used. Each container can be manually positioned by the operator under a pressure actuator or the pressure actuator can be positioned over the container. The dispenser may also include an HMI, a scale and a feedback sensor. Again, the method of use is similar to that described above.

Still another exemplary embodiment of the dispenser holds one or a plurality of containers in either a linear configuration (through the use of a linear slide) or a rotary configuration (through the use of a rotary table) and, within each resides a single base material which, if required of a desired formulation, in some calculated proportion, is used. Each container is manually positioned by the operator under a pressure actuator. The dispenser may also include an HMI and a scale. In this method of use, the operator inputs into the HMI a value of the desired finished amount of a custom formulation to blend. The HMI calculates the total weight of each of the base material components required to create the target amount. The operator then positions a container to the dispense position which is the area under a pressure actuator. The pressure actuator is manually activated by the operator to apply downward pressure on the movable puck which pushes the base material through a proportional pressure responsive dispense valve that opens and closes in a rolling manner into a receiving container residing on a scale. As the base material is expelled through the dispense valve and falls into the receiving container the base material is weighed by the scale and the operator may increase, decrease or discontinue the pressure being manually applied to the puck in the material container by the pressure actuator to provide the calculated amount. When the operator discontinues applying pressure to the pressure actuator the dispense valve effectively stops expelling the base component from the material container. The operator then reads the scale value and determines if more base material is required to reach the calculated amount. The operator repeats the above steps until the calculated amount required of the formulation is attained. When the calculated amount is attained the operator positions the next material container required of the formulation, if another is required, into a position under the pressure actuator and repeats the process until the calculated amount of each base material components of the required formulation have been dispensed into the receiving container.

Yet another embodiment of the dispenser holds a single material container in which resides a single base material which, if required of a desired formulation, in some calculated proportion, is used. Each material container is manually inserted by the operator into the dispense position under the pressure actuator. The dispenser may also include an HMI, a scale and a feedback sensor. In one method of use, the operator inputs into the HMI a value of the desired finished amount, i.e., the target amount in a value of total weight, of a custom formulation to blend. The HMI calculates the total weight of each of the base material components required to create the target amount. The pressure actuator applies downward pressure on the movable puck which pushes the base material through a proportional pressure responsive dispense valve that opens and closes in a rolling manner into a receiving container residing on a scale. As the base material is expelled through the valve, the base material is sensed by a sensor which, along with the scale, sends feedback information to the HMI to increase, decrease or discontinue the pressure being applied to the puck in the material container by the pressure actuator to provide the calculated amount. If the amount of base material expelled does not equal the calculated amount the HMI recalculates the amount of base material required (the "recalculated amount"), recalculates the amount of pressure required of the pressure actuator to attain the recalculated amount, and sends a signal to the pressure actuator to expel the recalculated amount of base material from the material container. The process of expelling a base amount, receiving feedback from the sensor and the scale, calculating if more base material is required and, if required, recalculating the amount of pressure required of the pressure actuator to attain the total recalculated amount continues until the calculated amount is attained. When the calculated amount is attained the operator removes the material container and inserts the next material container required of the formulation, if another is required, into a position under the pressure actuator and repeats the process until the calculated amount of each base material components of the required formulation have been dispensed into the receiving container.

Still another exemplary embodiment of the dispenser holds a single container within resides a single base material which, if required of a desired formulation, in some calculated proportion, is used. Each container is manually positioned by the operator under a pressure actuator. The dispenser may also include an HMI and a scale. In this method of use, the operator inputs into the HMI a target amount of the desired finished amount of a custom formulation to blend. The HMI calculates the total weight of each of the base material components required to create the target amount. The operator then positions a container to the dispense position which is the area under a pressure actuator. The pressure actuator is manually activated by the operator to apply downward pressure on the movable puck which pushes the base material through a proportional pressure responsive dispense valve that opens and closes in a rolling manner into a receiving container residing on a scale. As the base material is expelled through the dispense valve and falls into the receiving container the base material is weighed by the scale and the operator may increase, decrease or discontinue the pressure being manually applied to the puck in the material container by the pressure actuator to provide the calculated amount. When the operator discontinues applying pressure to the pressure actuator the dispense valve effectively stops expelling the base component from the material container. The operator then reads the scale value and determines if more base material is required to reach the calculated amount. The operator repeats the above steps until the calculated amount required of the formulation is attained. When the calculated amount is attained the operator positions the next material container required of the formulation, if another is required, into a position under the pressure actuator and repeats the process until the calculated amount of each base material components of the required formulation have been dispensed into the receiving container.

Another aspect of the present invention is an improved container that may be used in the dispensing of material. In one exemplary embodiment, the container may be in the form of a material bag that comprises a substantially air-tight, flexible, compressible composite selected from among urethane, vinyl laminated fabric, chloroprene, viscoelastic fabric, buna-N, vinyl, cloth inserted rubber, polytetraflouroethane, elastomeric rubber, polypropylene, fluoroelastomers, rubber, hyplon, polyethylene, neoprene, polyvinylchloride, nitrile, polyolefin films, nylon, prismatic films, lycra, polyurethane, and the like.

The bag has a top, bottom and sides, sealed airtight, and also has a centered opening adjacent to the top in the form of a hole large enough to accept the clear passage of a molded fitting secured into it, becoming an integral part of the material bag. The bag also has a bag spout that provides for: 1) an opening in which to fill the material bag with material; 2) an opening in which to evacuate the material bag of material; 3) a means of connecting material bag to the dispenser; and 4) a means of connecting a pressure responsive silicone dispense valve to it. The material bag may incorporate a proportional elastomeric dispense valve or pressure responsive dispense valve. The material bag may also have a delta seal (a sealed-tight seam on an angle to its starting point) on any one its four corners, each of which may decrease the opportunity for material to become trapped within that area and which directs material in the direction of the bag spout throughout the process of evacuation of material from the material bag when pressure is applied to the material bag.

Another aspect of the present invention is an improved container, such as a cylindrical container or a material cartridge, that incorporates the proportional elastomeric dispense valve or pressure responsive dispense valve into the discharging end of the container. The dispense valve opens and closes rollingly in response to a predetermined discharge force, allowing stored material to precisely discharge from the container.

Still another aspect of the present invention is an improved movable member such as a puck (residing within the material container used to push the base material out of the container). The improved puck includes a number of seals around it's outside edge which effectively presses base material out of the material container through the dispense valve without allowing the material to bypass the puck. Additionally, the puck has a convex center that permits ample room for the dispense valve (found centered on the fixed end of the cartridge container) to close when the puck comes in direct contact with the fixed end of the cartridge. The puck is angled or configured on its bottom in such a way as to mate up with the fixed end of the container to decrease the amount of base material that may remain after the puck comes in contact with the fixed end of the container and subsequently provides the greatest opportunity for all of the base material in the container to be expelled from the container.

There are numerous potential uses for any of the dispensers described herein, including those uses described herein. One of skill in the art will appreciate that the illustrative uses described herein are exemplary of the numerous possible applications and uses of the disclosed dispensers and that the invention is not limited to the described uses. One exemplary use of the dispenser may be when the end-user requires the dispenser to provide large quantities of finished product to satisfy any given project requirements and to create the finished product in a commercially acceptable timeframe. For example, in the ink industry a printer may need to create enough of a custom color (i.e., 50.00 lbs. of finished product) to produce 100,000 sheets of finished printed pages. The formulation may require a majority of the finished product to be made from one or more of the components in the formulation (e.g., 90% of the finished product being made from two components). The end-user may require the dispenser to provide a high-speed, high-flow dispensing manner for any of the components to create the finished product (hereinafter referred to as a "coarse fill method").

In an aspect of the invention, the coarse-fill method may use a combination of: 1) a plurality of detached alternate drum material reservoirs each having a single drum pump attached and each of which supplies a component to a preferred or to an alternate valve, and thereafter through the dispenser, and 2) a plurality of integral material reservoirs which use a component source possibly in the form of a material bag to supply material to a valve, and thereafter through the dispenser. If the formulation requires a coarse fill method for any of the given components, the dispenser would initially dispense material using the coarse fill method to an amount approximately 1 lb. from the total target amount for that component. The remaining amount of component needed to attain the total amount required by the formulation for that component would be dispensed through the precision metering cylinder manner of dispensing (hereinafter referred to as a "small quantity method").

Any of the material containers described herein may incorporate the pressure responsive dispense valve of the invention and could be used in an accessory piece of equipment to mechanically assist in expelling material (i.e., inserted into an automated dispenser, inserted into a manual tool (such as a typical caulk gun), or inserted into an automated dispenser that, along with the HMI maintains a given level of material in a receiving container (often seen on printing presses and commonly know in the industry as "Fountain Fillers")). Any of the containers described herein which incorporate the pressure responsive dispense valve of the invention could be used independent of an automated means of expelling the material (i.e., by physically applying pressure to the container or, if the container is a material bag, to the material bag).

Other features and advantages of the invention will become apparent to those skilled in the art upon review of the following detailed description, claims and drawings in which like numerals are used to designate like features.

BRIEF DESCRIPTION OF THE DRAWINGS

FIG. 6 depicts several views of an alternative container with the proportional dispense valve assembly of FIG. 5.

Other features and advantages of the invention will become apparent to those skilled in the art upon review of the following detailed description, claims and drawings in which like numerals are used to designate like features.

DETAILED DESCRIPTION OF THE INVENTION

The present invention may be embodied in many forms and many methodologies. As used herein, the following terms have the following broad meaning as understood by those of skill in the art. Note that these definitions are intended to simply assist the reader in understanding the terms used herein and are not meant to provide a limiting definition to each term. The term "material" means a flowable, non-solid substance, such as liquid, paste or powder, or any other substance capable of dispensing. The term "formulation" means a prescribed recipe of a number of material components typically divided, according to their individual requirements, by percentages that, when dispersed or thoroughly mixed together, create a desired finished product. The terms "container" or "material container" mean any and all devices or structures, in which one or more materials may be contained, held, packaged into, received in, stored in or used as delivery package, including without limitation any and all structures identified herein. The term "HMI" means human/machine interface or one or more devices that allow for an interface between those devices and humans for the control of equipment or processes of equipment, and more generally may be defined as the layer or device that separates a human that is operating the equipment from the equipment itself. The term "downwards" means as being towards the direction of the bottom of FIG. 1. Likewise, the term "upwards" means as being towards the direction of the top of FIG. 1.

Figure 1:
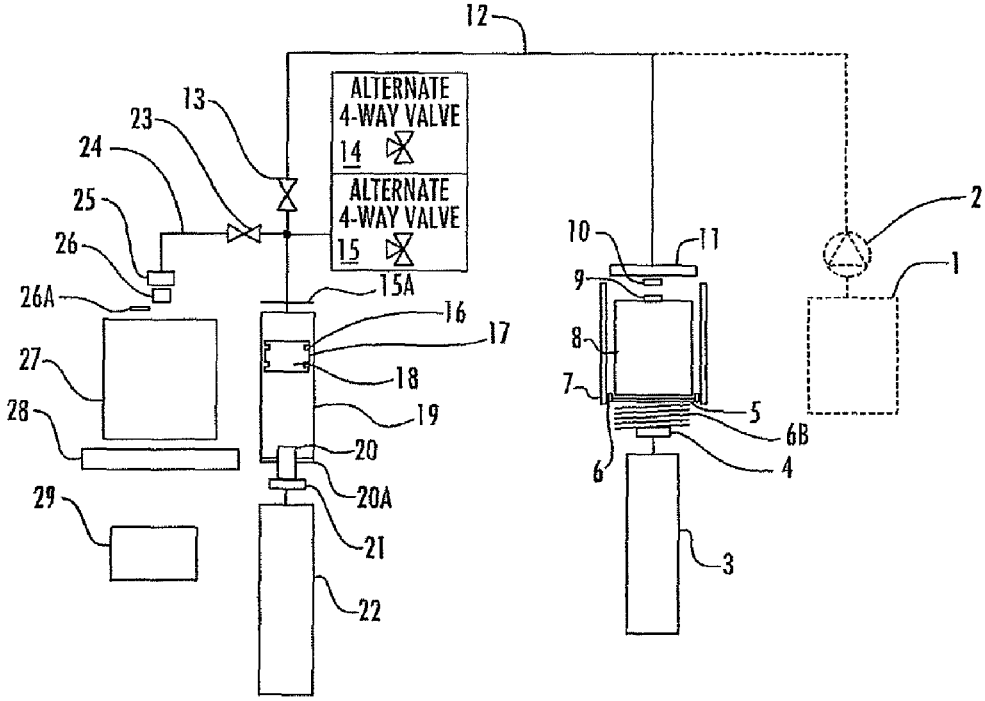
FIG. 1 is a schematic diagram of a single component assembly of an exemplary dispenser.

Referring to FIG. 1, there is depicted a schematic of a dispenser of an exemplary embodiment of the invention. The dispenser may include a human/machine interface or HMI 29 that sends a signal to either a detached drum pump 2 or to bag pressure actuator 3, depending upon the volume and speed requirements of the component for the formulation. For formulations requiring the coarse fill method of dispensing for any component, HMI 29 would signal supply valve 13 to open entirely and would signal dispense valve 23 to open entirely and would signal detached drum pump 2 to start. Detached drum pump 2 would move the component from alternate material reservoir 1 through supply tube 12, through supply valve 13, through dispense tube connecting plate 15A, into dispense cylinder 19, through dispense valve 23, through dispense tube 24, through dispense valve housing 25 and, in having developed enough pressure throughout the embodiments described above, would cause proportional dispense valve or pressure responsive dispense valve 26 to open rollingly and material would pass through the proportional dispense valve and would pass through material sensor 26A (a device used to detect the presence of a solid volume of material) and into receiving container 27 which sits upon scale 28.

Figure 3:
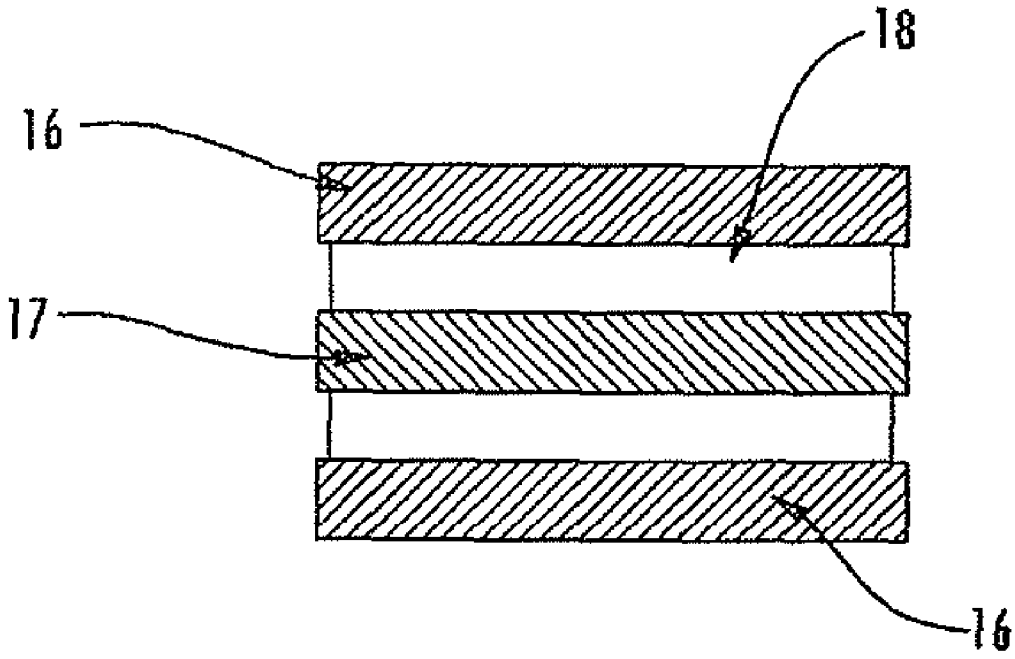
FIG. 3 is a schematic diagram of an exemplary piston assembly.

The piston assembly (as seen as an assembly in FIG. 3 and as seen as individual embodiments in FIG. 1) comprised of piston body 18 which may be formed in a manner to provide for a means of maintaining perpendicularity of the bottom of the piston body to the inside walls of dispense cylinder 19 through the use of a number of piston alignment rings 17 of varying dimension located between the piston seals 16 and a number of (most preferable two) piston seals 16, that reside within dispense cylinder 19, and could, as an entire assembly, freely move upwards in direction or freely move downwards in direction within dispense cylinder 19. The piston assembly (FIG. 3) is prevented from passing through the bottom of dispense cylinder 19 (as seen as being towards the direction of the bottom of FIG. 1) through the use of piston stop ring 20A (as shown in FIG. 1). The piston assembly (FIG. 3) is prevented from passing through the top of dispense cylinder 19 (as seen as being towards the direction of the top of FIG. 1) through the use of dispense tube connecting plate 15A (as shown in FIG. 1).

The piston assembly (FIG. 3) may move downwards in direction within dispense cylinder 19 due to piston body 18 having pressure exerted onto the top of it by the component when the component is moved: 1) from alternate material reservoir 1 through the use of detached drum pump 2, or 2) from material bag 8 through the use of bag pressure actuator 3. Either source of material may cause the voided area created above the piston assembly caused by the downwards movement of the piston assembly in dispenser cylinder 19 to fill with material. In either case, the filling of the void above the piston assembly and the downwards movement of the piston assembly may be assisted by the piston body 18, when piston body 18 has piston gripper 20 (of which the exemplary embodiment would be piston gripper 20 which has a bladder, which, when expanded with air, firmly attaches itself to the void inside of piston body 18) firmly attached to it and when piston assembly is drawn in a downwards direction by piston pressure actuator 22. The downwards movement of the piston assembly may create a vacuum inside dispense cylinder 19 above piston body 18 and may assist in filling of the void created inside dispense cylinder 19 above piston body 18. Piston alignment rings 17 would assure that piston body 18 travels in a parallel linear motion to dispense cylinder 19 sidewalls. Piston seals 16 would provide for a substantially leak-free contact between piston body 18 and the interior cylinder walls of dispense cylinder 19. Piston seals 16 would prevent the component from bypassing piston body 18 and would cause the component to remain in the area of dispense cylinder 19 above piston body 18.

Two alternative embodiments to supply valve 13 and dispense valve 23 would be: 1) an alternate 4-way valve 14, or 2) an alternate 3-way valve 15. With either alternate embodiment to supply valve 13 and dispense valve 23, detached drum pump 2 would move its component from alternate material reservoir 1 through supply tube 12 and through either: 1) alternate 4-way valve 14 which would, upon receiving a signal from HMI 29, switch alternate 4-way valve 14 to direct the component to either: a) pass through dispense tube connecting plate 15A into dispense cylinder 19 (when the small quantity method of dispensing is required to complete the component requirement of a formulation), or b) through dispense tube 24 and onwards through other embodiments as described above (when the coarse-fill method of dispensing is required to satisfy a user requirement) or 2) alternate 3-way valve 15 which would, upon receiving a signal from HMI 29, switch alternate 3-way valve 15 to direct the component through dispense tube connecting plate 15A and into dispense cylinder 19.

When HMI 29 receives a signal from scale 28 that the target value for the component (that uses the coarse fill method of dispensing) has been attained HMI 29 signals detached drum pump 2 to stop.

Figure 2A:
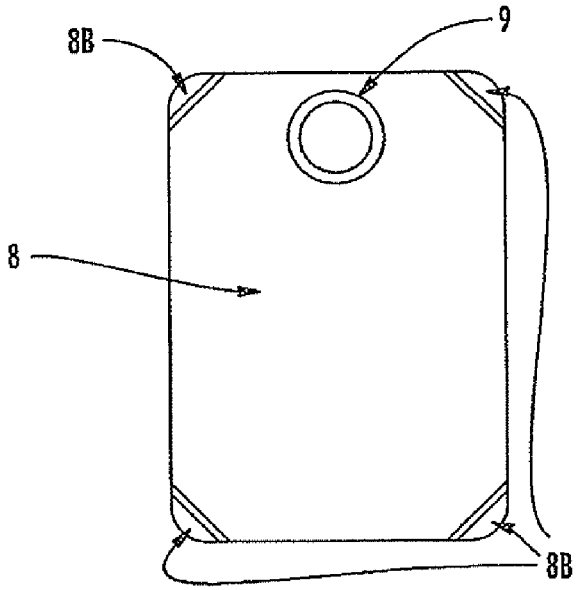
FIGS. 2A-B are schematic diagrams of an exemplary material bag assembly.
Figure 2B:
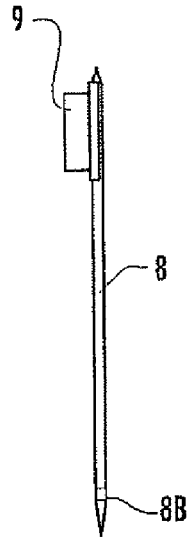
Figure 4:
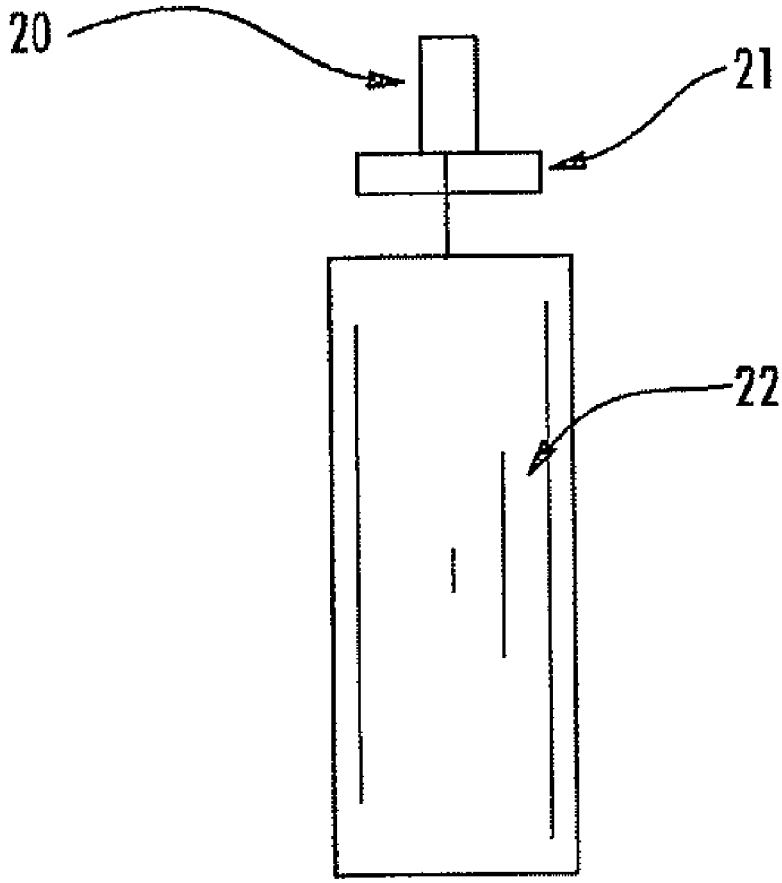
FIG. 4 is a schematic diagram of an exemplary linear actuator assembly.

HMI 29 would signal supply valve 13 to close, or would signal alternate 4-way valve 14 or alternate 3-way valve 15 to switch to direct material from dispense cylinder 19 to the direction of dispense tube 24, and would signal piston pressure actuator assembly (as seen as an assembly in FIG. 4 and as seen as individual embodiments in FIG. 2) to move piston drive plate 21 (which has piston gripper 20 firmly attached to it) upwards to locate and come into positive contact with piston body 18.

HMI 29 would signal piston pressure actuator assembly to move piston drive plate 21 upwards a defined distance (which defined distance is equal to the amount of incremental movement of piston body 18 upwards that would result in an amount of component being evacuated from that amount of material residing above piston body 18 and in dispense tube 24) that would equal some percentage of the component amount (as being an amount identified by HMI 29 and transmitted to scale 28) required to equal the total target amount required of that component for the formulation, minus the amount previously dispensed of that component (in the coarse-fill manner described above). Depending upon the allowable percentage of error (hereinafter referred to as "tolerance") that any particular component may have (of which each tolerance value is related to the target amount of the required component) HMI 29 may require dispenser to dispense component to an amount that is less than the overall required amount of the component. This process of dispensing an amount that is "short" of the required amount continues until the target value has been attained. The upwards movement of piston body 18 would cause component to move through dispense valve 23, through dispense tube 24, through dispense valve housing 25 and, in having developed enough pressure throughout the embodiments described above, would cause proportional dispense valve 26 to open rollingly and component would pass through proportional dispense valve 26, would pass through material sensor 26A and into receiving container 27 which sits upon scale 28.

The speed at which piston pressure actuator 22 moves upwards or downwards, and resultantly moves piston body 18 to dispel or fill material into or out of dispense cylinder 19, may be the same for all component assemblies of the embodiment, but most preferably the speed would be able to be limited and controlled, on a per component assembly basis as a function of the viscosity and rheological properties of the material and by the amount of material needing to be displaced.

Upon reaching the target weight required of the component for the formulation, scale 29 would send a signal to HMI 29 which would cause the piston pressure actuator assembly to stop the upwards movement of piston drive plate 21. HMI 29 would command piston gripper 20 to positively affix itself to piston body 18. HMI 29 would command piston pressure actuator 22 to reverse its direction and move downwards a defined distance. The defined distance of downward movement of piston drive plate 21 is equal to the distance required to decrease the amount of pressure created throughout the embodiments due to the process of dispensing which would result in enough reduction in pressure to cause proportional dispense valve 26 to close.

Figure 5:
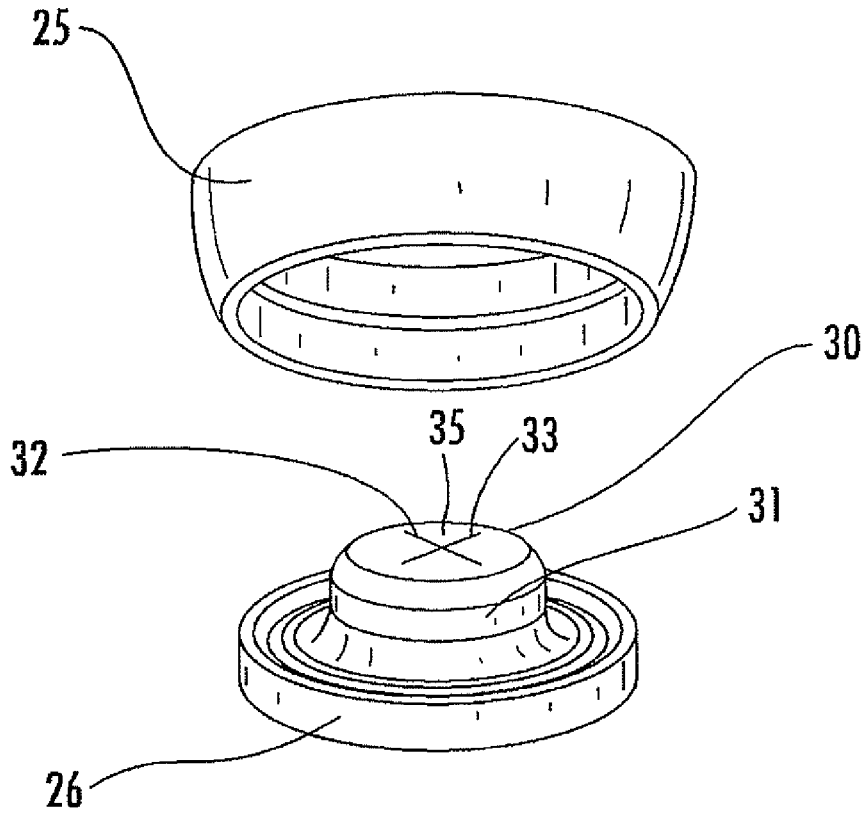
FIG. 5 is a schematic diagram of an exemplary proportional dispense valve assembly.

Each proportional dispense valve 26, of which a single proportional dispense valve 26 is illustrated in FIG. 5, is a pressure responsive one-way valve of an elastomeric material that resides and is held fast in dispense valve housing 25. Proportional dispense valve 26 opens rollingly when the force and pressure of material on it forces it open, and closes effectively and completely when the force and pressure exerted drops. Any and all elastomeric valves which open and close in response to a predetermined discharge force may be used with the invention. Silicone is the preferred material used for elastomeric valves; however, other materials may be used.

Proportional dispense valve 26 (as seen in FIG. 5) includes a valve head 30 that defines one or more slits 33 that form one or more flaps 35 and that shift outward (as seen as being towards the direction of the bottom of FIG. 5) to cause a connector sleeve 31 to double over and extend rollingly, to thereby apply a pressure to the valve head 30 which assists in opening the valve orifice 32. On release of pressure, valve orifice 32 closes and the valve head 30 shifts to a retracted position. Suitable valves are made by Liquid Molding Systems, Inc. under the trademark SureFlo, and U.S. Pat. Nos. 5,439,143 issued Aug. 8, 1995, 5,339,995 issued Aug. 23, 1994, and 5,213,236 issued May 25, 1993 are understood to describe these valves. The identified patents are incorporated by reference. One of skill in the art will understand that other configurations of the dispense valve may be used with the invention including those that define slits but do not necessarily open and close in the same manner as the illustrated dispense valve 26, that is, do not open and close in a rolling and extending manner. Rather, valves that include slits to form flaps that open and close may be used with the invention.

Dispense valve housing 25 may have a means of preventing valve orifice 32 from extending beyond its normally closed position thereby prohibiting air from entering into the area above dispense valve 26. Dispense valve housing 25 utilizing such a means would result in creation of a "one-way" valve, thus allowing material to pass through dispense valve 26 in only one direction. The dispense valve 26 configured with the material containers, including the material bag, describe herein, improves upon the current container design by offering a means to cleanly and effectively stop the flow of a material from such container, thereby overcoming the known problems of the "stringing" of material from the current containers orifice and the ineffective means it provides for stopping the flow of material from the container orifice.

Another use of the dispenser may be when the end-user requires the dispenser to provide small quantities of finished product to satisfy any given project requirements and to create the finished product in a commercially acceptable time-frame. For example, in the ink industry a printer may need to create enough of a custom color (i.e. 10.00 lbs. of finished product) to produce 10,000 sheets of finished printed pages. The end-user may require the dispenser to provide a small-volume of finished product using the small quantity method.

Referring to FIG. 1, the small quantity method of using the dispenser may use a plurality of integral material reservoirs which use a component source in the form of the previously described material bag to supply material to a preferred or to an alternate valve, and thereafter through the dispenser embodiments as described below.

The operator inserts material bag 8 (as in FIG. 1) (which is pre-filled by the ink manufacturer with a material as required by the formulation being created) into the bag reservoir 7. HMI 29 sends a signal to bag pressure actuator 3 (or any other device capable of exerting enough pressure on material container (material bag 8 described above)) to be able to force the component residing in the material container through the other embodiments as illustrated in FIG. 1.

For formulations requiring the small volume method of dispensing for any formulation, HMI 28 would signal supply valve 13 to open entirely and would signal dispense valve 23 to open entirely and would signal bag pressure actuator 3 to start. Pressure actuator 3 would move bag drive plate 4 upwards to locate and come into positive contact with bag plate 5 which in turn would press upwards and would move its component from material bag 8 through supply tube 12, through supply valve 13, through dispense tube connecting plate 15A, into dispense cylinder 19, through dispense valve 23, through dispense tube 24, through dispense valve housing 25 and, in having developed enough pressure throughout the embodiments described above, would cause proportional dispense valve 26 to open rollingly and material would pass through proportional dispense valve 26, would pass through material sensor 26A (a device used to detect the presence of a solid volume of material, which may be of video or beam-type) and into receiving container 27 which sits upon scale 28.

The container material bag 8 may have a spout clamp 10 (a spring-release clamp device that securely affixes the material bag 8 to the cylinder material reservoir cover 8, assuring a leak-free connection) affixed to bag spout 9. Cylinder material reservoir cover 11 becomes firmly attached to the dispenser and provides for a positive connecting point between bag reservoir 7 and tube supply 12. Bag overlap seal 6, being firmly attached to bag plate 5, extends outwards beyond the diameter of bag plate 5 and is made from an elastomeric material, of which polyester is the most preferred, and comes in positive radial contact with the inside walls of bag reservoir 7 (most preferable tubular polyvinyl chloride, open at both ends, which is integrated into the dispenser and which receives and contains material bag 8) and prevents material bag 8 from by-passing bag plate 5 when pressure is exerted on bag plate 5 from bag drive plate 4 (which is driven by bag pressure actuator 3).

When material in material bag 8 is fully expelled and when material bag 8 needs to be replaced the operator removes cylinder material reservoir cover 11 from the dispenser, releases spout clamp 10 from cylinder material reservoir cover 11 and from expelled material bag 8, inserts replacement (filled) material bag 8 into bag reservoir 7, connects spout clamp 10 to bag spout 9 and to cylinder material reservoir 11 and attaches cylinder material reservoir 11 to the dispenser. When a replacement material bag 8 is placed in bag reservoir 7, spring 6B, residing inside bag reservoir 7 and under bag plate 5, is open throughout its center to allow for free passage of bag drive plate 4 through its open center. Spring 6B presses upon the underside of bag plate 5 and resultantly presses filled material bag 8 upwards in bag reservoir 7 to prevent stress from exerting on bag spout 9 when filled material bag 8 is inserted in bag reservoir 7.

The piston assembly (as seen as an assembly in FIG. 3 and as seen as individual embodiments in FIG. 1) comprised of piston body 18 which may be formed in a manner to provide for a means of maintaining perpendicularity of the bottom of the piston body to the inside walls of dispense cylinder 19 through the use of a number of piston alignment rings 17 of varying dimension located between the piston seals 16 and a number of (most preferable two) piston seals 16 that reside within dispense cylinder 19, and could, as an entire assembly, freely move upwards or freely move downwards in direction within dispense cylinder 19. The piston assembly (FIG. 3) is prevented from passing through the bottom of dispense cylinder 19 (as seen as being towards the direction of the bottom of FIG. 1) through the use of piston stop ring 20A (as shown in FIG. 1). The piston assembly (FIG. 3) is prevented from passing through the top of dispense cylinder 19 (as seen as being towards the direction of the top of FIG. 1) through the use of dispense tube connecting plate 15A (as shown in FIG. 1).

The piston assembly (FIG. 3) may move downwards in direction within dispense cylinder 19 due to piston body 18 having pressure exerted onto the top of it by the component when the component is moved: 1) from alternate material reservoir 1 through the use of detached drum pump 2, or 2) from material bag 8 through the use of bag pressure actuator 3. Either source of material may cause the voided area created above the piston assembly caused by the downwards movement of the piston assembly in dispense cylinder 19 to fill with material. In either case, the filling of the void above the piston assembly and the downwards movement of the piston assembly may be assisted by the piston body 18, when piston body 18 has piston gripper 20 firmly attached to it and when the piston assembly is drawn in a downwards direction by piston pressure actuator 22. The downwards movement of the piston assembly may create a vacuum inside dispense cylinder 19 above piston body 18 and may assist in filling of the void created inside dispense cylinder 19 above piston body 18. Piston alignment rings 17 would assure that piston body 18 travels in a parallel linear motion to dispense cylinder 19 sidewalls. Piston seals 16 would provide for a substantially leak-free contact between piston body 18 and the interior cylinder walls of dispense cylinder 19. Piston seals 16 would prevent the component from bypassing piston body 18 and would cause to have component remain in the area of dispense cylinder 19 above piston body 18.

Two alternative embodiments to supply valve 13 and dispense valve 23 would be: 1) alternate 4-way valve 14, or 2) alternate 3-way valve 15. With either alternate embodiment to supply valve 13 and dispense valve 23, bag pressure actuator 3 would move bag drive plate 4 upward to locate and come into positive contact with bag plate 5 which in turn would press upwards and would move the component from material bag 8 through supply tube 12 and through either: 1) alternate 4-way valve 14 which would, upon receiving a signal from HMI 29, switch alternate 4-way valve 14 to direct the component to either: a) pass through dispense tube connecting plate 15A into dispense cylinder 19 (when the small quantity method of dispensing is required to complete the component requirement of a formulation), or b) through dispense tube 24 and onwards through other embodiments as described above or 2) alternate 3-way valve 15 which would, upon receiving a signal from HMI 29, switch alternate 3-way valve 15 to direct the component through dispense tube connecting plate 15A and into dispense cylinder 19.

When HMI 29 receives a signal from scale 28 that the target value for the component (that uses the small volume method of dispensing) has been attained HMI 29 signals bag pressure actuator 3 to stop.

HMI 29 would signal supply valve 13 to close, or would signal alternate 4-way valve 14 or alternate 3-way valve 15 to switch to direct material from dispense cylinder 19 to the direction of dispense tube 24, and would signal piston pressure actuator assembly (as seen as an assembly in FIG. 4 and as seen as individual embodiments in FIG. 2) to move piston drive plate 21 (which has piston gripper 20 firmly attached to it) upward to locate and come into positive contact with piston body 18.

HMI 29 would signal piston pressure actuator assembly to move piston drive plate 21 upward a defined distance (which defined distance is equal to the amount of incremental movement of piston body 18 upward that would result in an amount of component being evacuated (from that amount of material residing above piston body 18 and in dispense tube 24)) that would equal the component amount (as being an amount identified by HMI 29 and transmitted to scale 28) required to equal the total target amount required of that component for the formulation, minus the amount previously dispensed of that component in the dispense manner bypassing dispense cylinder 19 described above). Depending upon the allowable percentage of error (hereinafter referred to as "tolerance") that any particular component may have (of which each tolerance value is related to the target amount of the required component) HMI 29 may require the dispenser to dispense component to an amount that is less than the overall required amount of the component. This process of dispensing an amount that is "short" of the required amount continues until the target value has been attained. The upwards movement of piston body 18 would cause component to move through dispense valve 23, through dispense tube 24, through dispense valve housing 25 and, in having developed enough pressure throughout the embodiments described above, would cause proportional dispense valve 26 to open rollingly and component would pass through proportional dispense valve 26, would pass through material sensor 26A and into receiving container 27 which sits upon scale 28.

The speed at which piston pressure actuator 22 moves upwards or downwards, and resultantly moves piston body 18 to dispel or fill material into or out of dispense cylinder 19, may be the same for all component assemblies of the embodiment, but most preferably the speed would be able to be limited and controlled on a per component assembly basis as a function of the viscosity and rheological properties of the material and by the amount of material needing to be displaced.

Upon reaching or not reaching the target weight required of the component for the formulation, HMI 29 would receive a reading from scale 28 and would determine whether to stop or not to stop the upwards movement piston pressure actuator 22 and its attached piston drive plate 21. If the target value for the component was attained HMI 29 would command piston gripper 20 to positively affix itself to piston body 18. HMI 29 would command piston pressure actuator 22 to reverse its direction and move downwards a defined distance. The defined distance of downward movement of piston drive plate 21 is equal to the distance required to decrease the amount of pressure created throughout the embodiments described above due to the process of dispensing.

The pressure throughout the embodiments would be reduced to an amount equal zero, or to an amount of pressure less that zero, whichever is required to provide enough pressure in the reverse manner to cause proportional dispense valve 26 to close.

Figure 12:
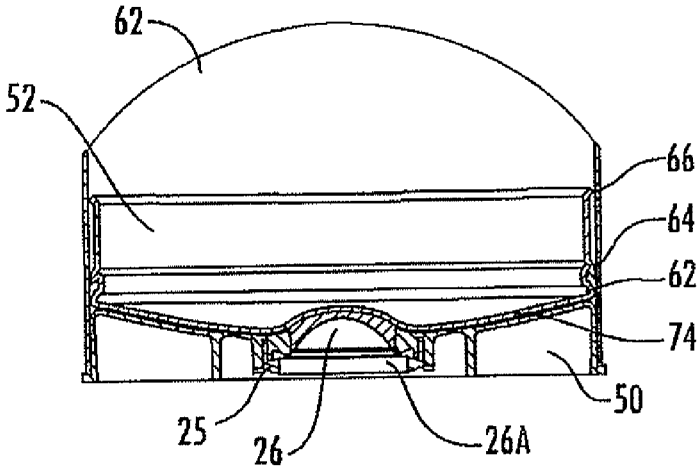
FIG. 12 is an exploded cross-section view of the end of the container of FIG. 11.

In another aspect of the invention, referring to FIG. 6, an improved container 62, such as a material cartridge, incorporates a proportional elastomeric dispense valve or pressure responsive dispense valve 26 into the discharging end 50 of the container and held fast to the discharge end 50 by a valve retaining ring 26A (FIG. 12). In an alternative embodiment, the dispense valve 26 is molded to the container 62 thus eliminating the need for a retaining ring. The dispense valve 26 opens and closes in response to a predetermined discharge force exerted on the stored material by a movable member such as a plunger puck 52 that forms a compression seal within the inner annular wall of the container 62. In one embodiment, the dispense valve opens and closes in a rolling manner. In another embodiment, the dispense valve may include one or more slits and one or more flaps that may simply open and close. A pressure actuator, plunger or similar device may be used in a controlled manner to exert a force on the movable member (e.g., puck 52) to thereby allow the stored material in the container to precisely discharge from the container 62. The pressure actuator, plunger or similar device may be manually operated or automated.

Figure 7:
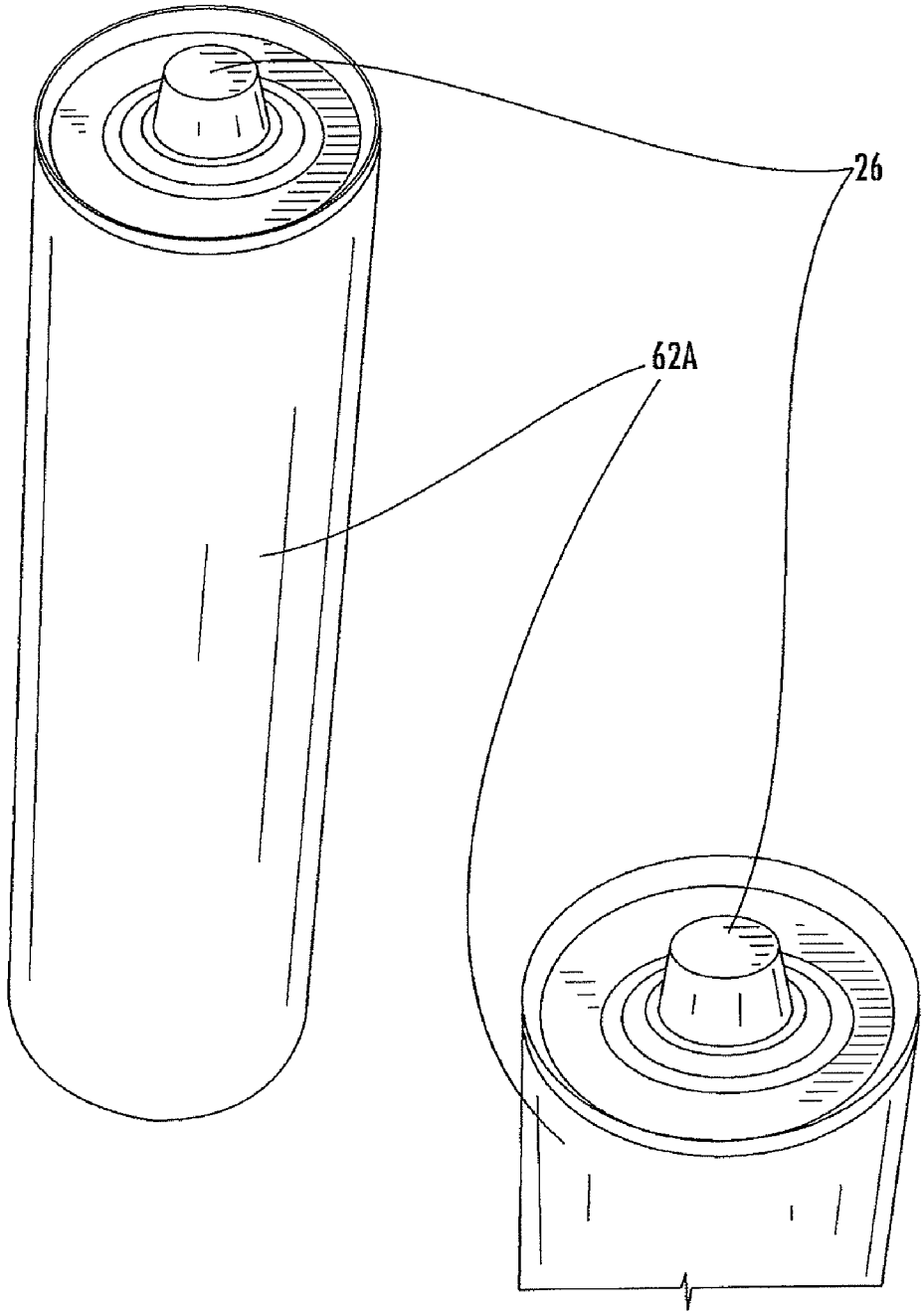
FIG. 7 depicts a full side view and a partial side view of an alternative container with the proportional dispense valve assembly of FIG. 5.

Referring to FIG. 7, another exemplary container 62*a* is depicted which may be in the form of a caulk tube for dispensing caulk. As shown in this figure, the dispense valve 26 may be incorporated onto the discharge end of the container 62*a* and similar to above, the dispense valve 26 may open and close in response to a predetermined discharge force exerted on the stored material by a plunger device. As can be appreciated, the exemplary containers may take on numerous shapes, sizes and configurations, all of which are within the scope of the invention.

Figure 11:
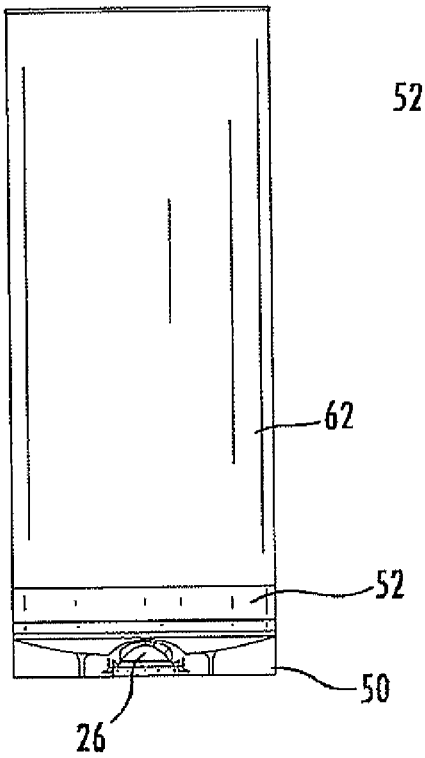
FIG. 11 is a cross-section view of the container of FIG. 10.
Figure 13:
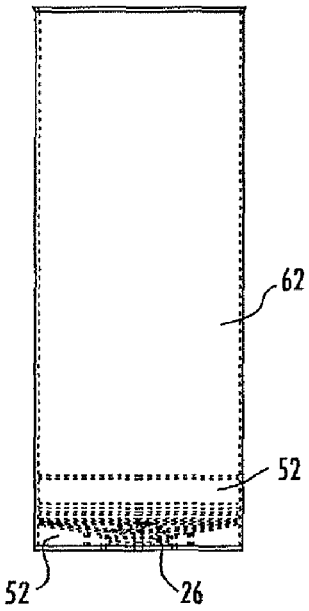
FIG. 13 is a schematic view of the container of FIG. 10 illustrating the mating up of the movable member with the interior bottom of the container.
Figure 14:
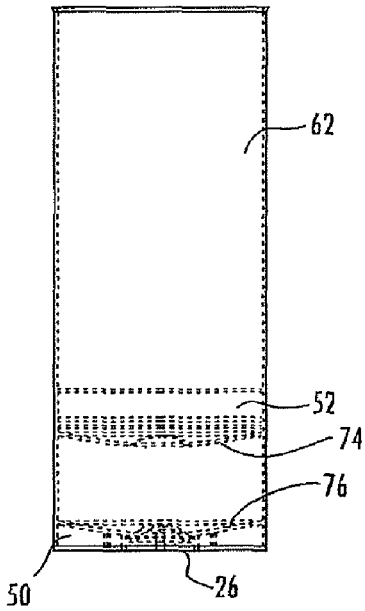
FIG. 14 is a schematic view similar to FIG. 13 illustrating the movable member in a position away from the interior bottom of the container.
Figure 15:
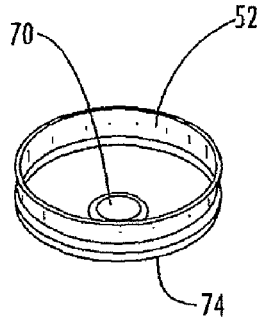
FIG. 15 is an isometric view of an exemplary movable member of the present invention.
Figure 16:
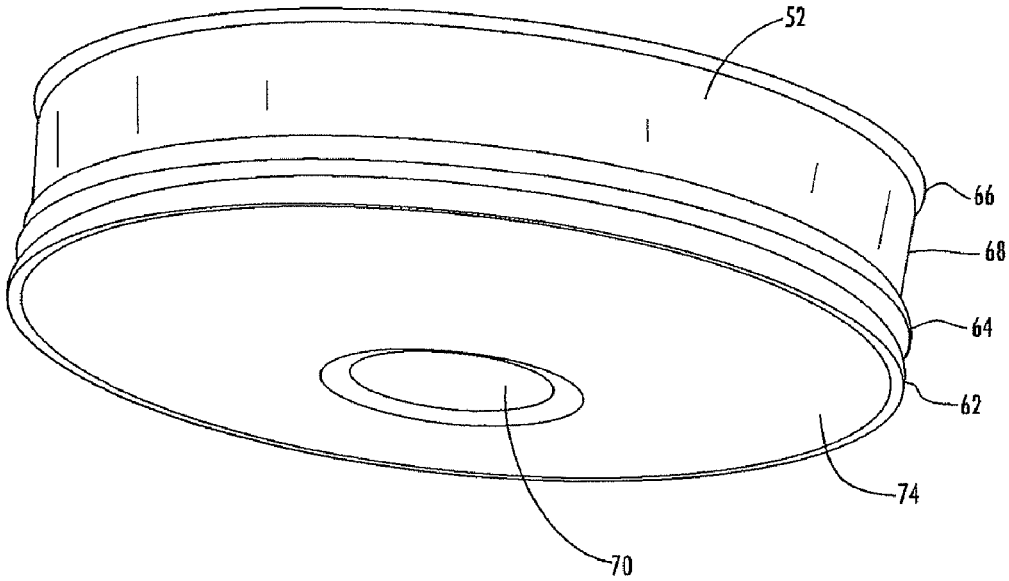
FIG. 16 is another isometric view of the movable member of FIG. 15.
Figure 17:
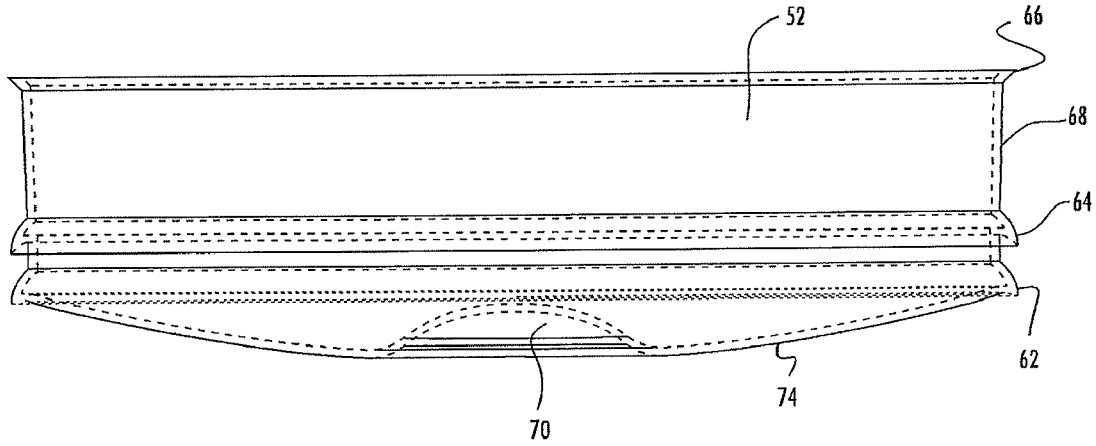
FIG. 17 is a side view of the movable member of FIG. 15.

Referring to FIGS. 16 and 17, the movable member, e.g., puck 52, includes a number of seals, such as seals 62, 64 and 66 around an outside edge 68 of the puck. The seals may be configured in a number of different ways including the illustrated configuration and may comprise any number of seals including just one seal. In one embodiment, the seals extend outwardly from the outer edge 68 and serve as a means for scraping and effectively pressing the material out of the container 62 through the dispense valve 26 to allow the removal of nearly all the material from the container. Additionally, the puck 52 has a contoured or angled bottom surface 74 that at its center forms a convex center 70 that is configured to permit ample room for the dispense valve 26 (typically centered on the fixed end of the cartridge container as illustrated in FIGS. 11 and 13) to close when the bottom surface 74 of the puck 52 comes in direct contact with the fixed end 50 of the container 62. As illustrated by FIGS. 13 and 14, the contoured or angled bottom surface 74 is configured to mate up with the interior surface 76 of the fixed end 50 of the container 62 to decrease the amount of base material that may remain in the container after the bottom surface of the puck 52 comes in contact with the fixed end 50 of the container. Significantly, with this configuration, nearly all the base material in the container will be expelled from the container, thereby reducing if not eliminating material waste. It should be understood that the bottom surface 74 may define other configurations that still permit the complete dispensing of material from the container. Additionally, the principles of the puck 52 configuration may be applied to any movable member, such as a press plate 87 (FIG.

9) or other structure, which can be used to push material out of a container. The puck 52 may be made of a plastic material, or any other suitable material.

Figure 8:
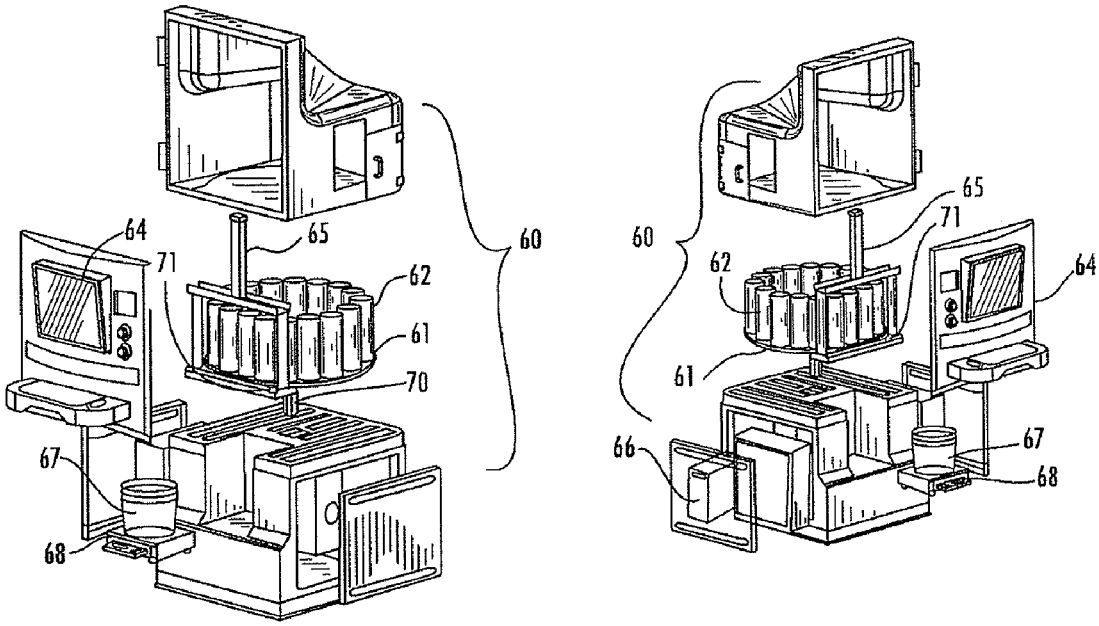
FIG. 8 are two exploded schematic diagrams of an alternative dispenser incorporating the alternative container of FIG. 6.

In another aspect of the invention, and referring to FIG. 8, a dispenser 60 may be used to dispense any given amount of material, according to a predetermined formulation, using an automated machine that may have a plurality of base material containers 62, each of which may incorporate a pressure-responsive, proportional dispense value 26.

Conventionally, specific amounts of base material in the ink, colorants, coatings, foodservice and chemicals industries are often mixed together to create a different finished product. As described above, the process of combining any number of base materials together (blending a formula) has historically been accomplished by a number of methods, including: 1) manually adding a specific amount of a number of base materials from an existing container into a receiving container, according to a predetermined formulation or recipe; or 2) using a piece of equipment (automatic or semi-automatic) that adds the appropriate amount of base material into a receiving container, according to a predetermined formulation or receipt, through the use of computer or program logic controller along with any number of mechanical metering devices that meter, pump and/or control the flow and amount of material being dispensed into the receiving container.

As stated above, the disadvantages with known dispensers is that the dispensers require the base materials to be transferred from a conventional container into a storage vessel that is integrated in the conventional dispenser and some dispensers require a container to be attached to the dispenser through the use of a hose, pump or press-plate from which the dispenser then draws the base material. As indicated above, both manners of supplying base material to the dispenser result in an undesirable amount of labor and creates a significant mess. In addition, when fully expelled, the conventional containers may have residual material remaining in them resulting in wasted material.

In an exemplary embodiment, the present invention seeks to improve upon the ease of use of the known dispensers through the use of the dispenser 60 and a container 62 that incorporates the pressure responsive valve 26. As described, the container 62 with the valve 26 is capable of effectively stopping the flow of the material through regulation of pressure applied to the material residing within the container. This allows the container to be placed into the exemplary dispenser 60, as depicted in FIG. 8, without the need of mechanically connecting it with a hose, or other means, to the dispenser 60. The exemplary container 62 may be of a shape and configuration similar to a Sonoco cartridge, a caulk tube, a material bag, as described herein, or any other shape or configuration.

Referring to FIG. 8, the exemplary dispenser 60 is depicted. The dispenser 60 includes a rotary table 61 that holds a plurality of containers 62 on the rotary table 61, which is housed in the dispenser 60. In an exemplary application, each container 62 contains a single base material used in some combination with a blend of a custom formulation.

Figure 9:
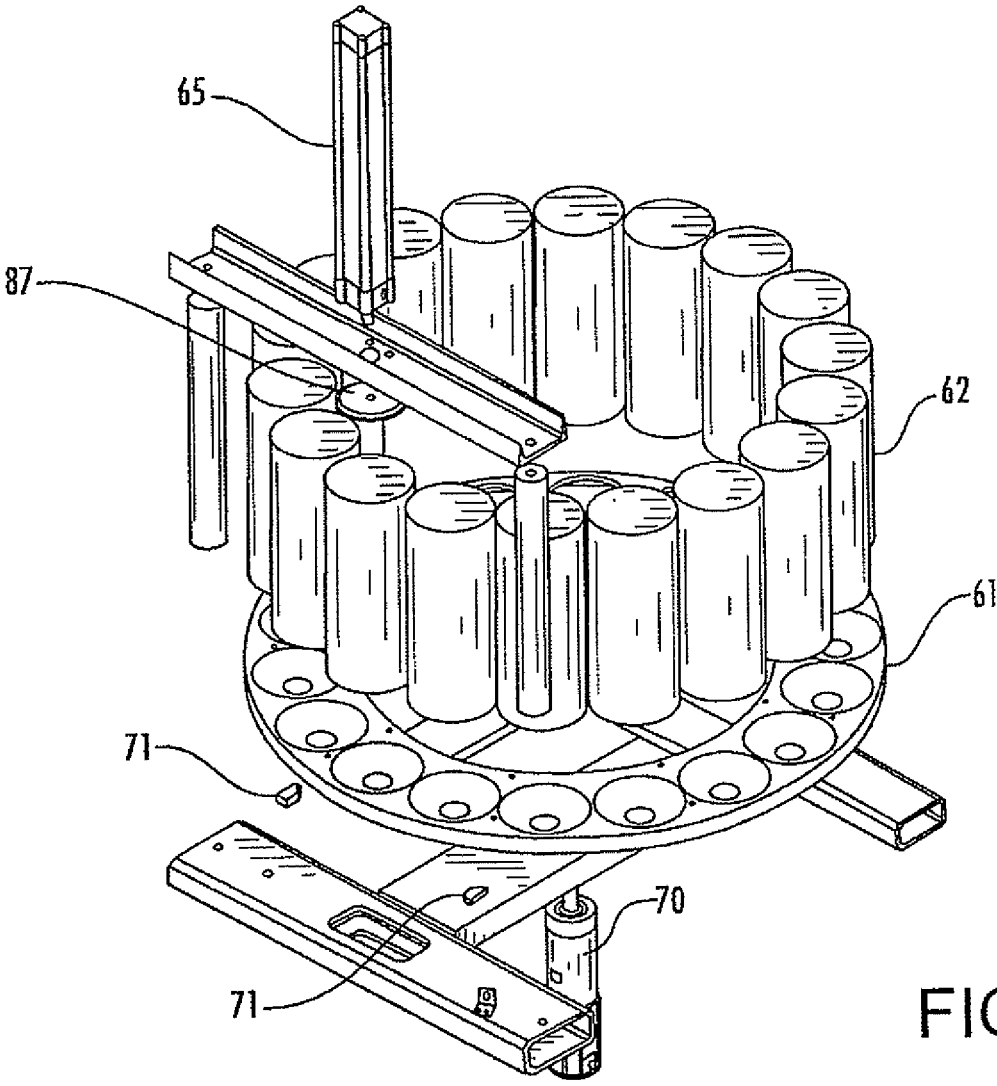
FIG. 9 is an exploded schematic diagram of the rotary assembly of the dispenser of FIG. 8.
Figure 10:
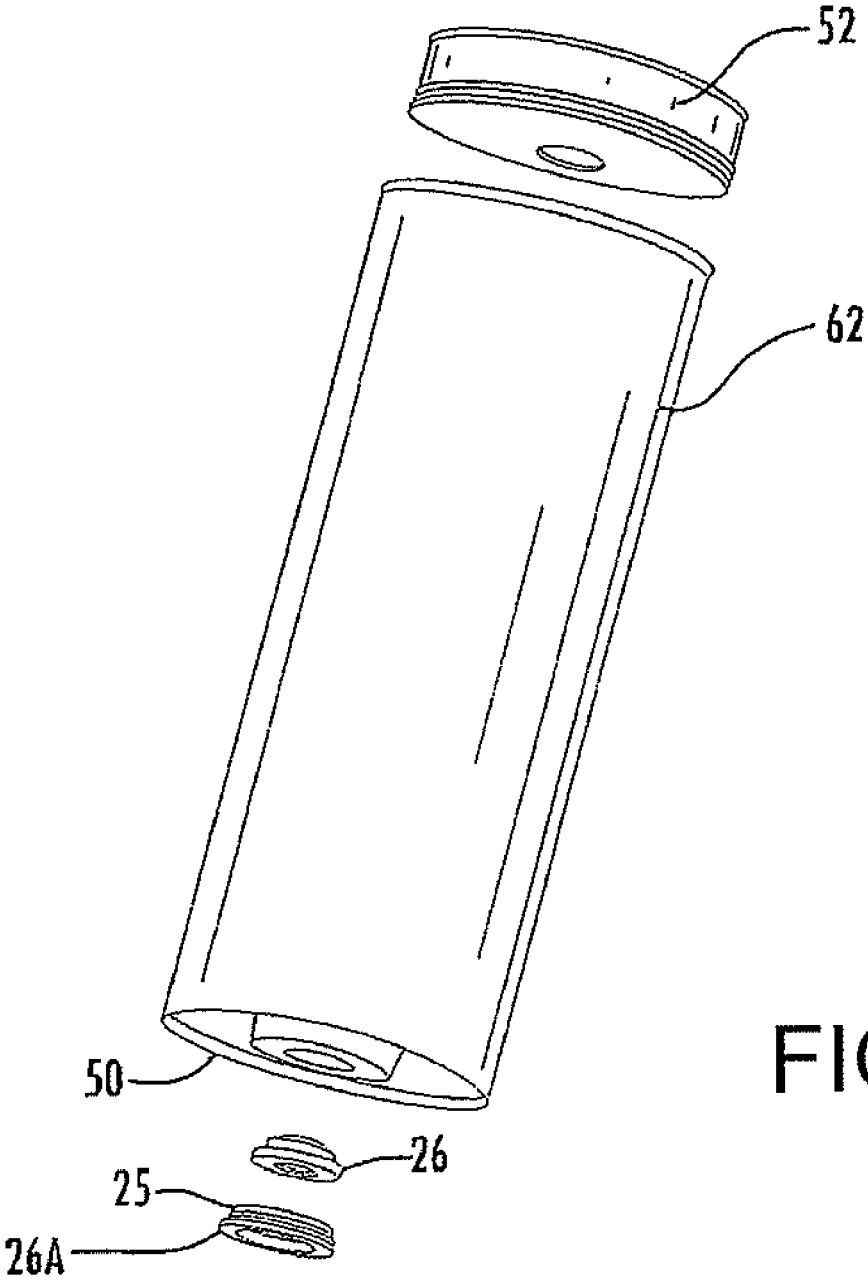
FIG. 10 is an exploded view of an exemplary container of the invention.

The dispenser 60 also incorporates a computer 64 and a material sensor 71. In use, the operator inputs into the computer 64 a value of the desired finished amount (weight) of a custom formulation to blend. The rotary table motor 70 rotates rotary table 61 and positions the container 62 required by the formulation to the dispense position, which is the area towards the front of the dispenser 60, under a pressure actuator 65 and above material sensor 71. The pressure actuator 65 may or may not have a plate attached to the end of the actuating shaft (such as plate 87 shown in FIG. 9), depending on which type of container 62 is being used in the dispenser 60. The computer 64 sends a signal to an HMI 66 which instructs the pressure actuator 65 to apply downward pressure on the container 62, and more specifically onto the puck 52 configured within one end of the container 62 (as shown in FIG. 10). The maximum amount of pressure allowable, based on the amount required to expel, is exerted by the pressure actuator 65 onto the puck 52 in the container 62 resulting in base material expelling through an orifice found on each container 62, in which a proportional pressure responsive dispense valve 26 is fixed and through or past a material sensor 71. The base material is expelled into a receiving container 67 residing on a scale 68.

As base material is expelled through valve 26, the valve will open rollingly to permit the base material to flow through, and the base material is sensed by the sensor 71 which, along with the scale 68 sends information to the HMI 66 and computer 64 to increase, decrease or discontinue the pressure being applied to the puck 52 in the container 62 by the pressure actuator 65. When the weight of base material being expelled into receiving container 67 achieves a predetermined weight, the computer 64 and HMI 66 may send a signal to the pressure actuator 65 to expel a minimal amount of base material from the container 62 (commonly referred to as "pulsing") in order to expel small amounts of base material to "pulse" up to the required base material amount as determined as a percentage of the total amount of custom formulation entered into the computer 64. The same process is completed for each base material required of the custom formulation.

In another embodiment, the dispenser may hold one or a plurality of containers in a linear configuration and, within each resides a single base material which, if required of a desired formulation, in some calculated proportion, is used. As above, each material container can be positioned under a pressure actuator. However, with this embodiment, the containers are moved under the pressure actuator 65, or the pressure actuator is moved over the containers in a linear manner, as opposed to the above-described rotary manner shown in FIGS. 8 and 9. The dispenser may also include an HMI 66, a scale 68 and a feedback sensor 71. The method of use may be similar to the method described above with respect to the rotary table configuration depicted in FIG. 8.

Yet another exemplary embodiment of the dispenser holds one or a plurality of containers in either a linear configuration (through the use of a linear slide) or a rotary configuration (through the use of a rotary table) and, within each resides a single base material which, if required of a desired formulation, in some calculated proportion, is used. Each container can be manually positioned by the operator under a pressure actuator. The dispenser may also include an HMI 66, a scale 68 and a feedback sensor 71. Again, the method of use is similar to that described above.

Still another exemplary embodiment of the dispenser holds one or a plurality of containers in either a linear configuration (through the use of a linear slide) or a rotary configuration (through the use of a rotary table) and, within each resides a single base material which, if required of a desired formulation, in some calculated proportion, is used. Each container is manually positioned by the operator under a pressure actuator, such as actuator 65. The dispenser may also include an HMI 66 and a scale 68. In this method of use, the operator inputs into the HMI a value of the desired finished amount of a custom formulation to blend. The HMI calculates the total weight of each of the base material components required to create the target amount. The operator then positions a container to the dispense position which is the area under a pressure actuator. The pressure actuator is manually activated by the operator to apply downward pressure on the movable puck which pushes the base material through a proportional pressure responsive dispense valve that opens and closes in a rolling manner into a receiving container residing on a scale. As the base material is expelled through the dispense valve and falls into the receiving container the base material is weighed by the scale and the operator may increase, decrease or discontinue the pressure being manually applied to the puck in the material container by the pressure actuator to provide the calculated amount. When the operator discontinues applying pressure to the pressure actuator the dispense valve effectively stops expelling the base component from the material container. The operator then reads the scale value and determines if more base material is required to reach the calculated amount. The operator repeats the above steps until the calculated amount required of the formulation is attained. When the calculated amount is attained the operator positions the next material container required of the formulation, if another is required, into a position under the pressure actuator and repeats the process until the calculated amount of each base material components of the required formulation have been dispensed into the receiving container.

Yet another embodiment of the dispenser holds a single material container in which resides a single base material which, if required of a desired formulation, in some calculated proportion, is used. Each material container is manually inserted by the operator into the dispense position under the pressure actuator. The dispenser may also include an HMI 66, a scale 68 and a feedback sensor 71. In one method of use, the operator inputs into the HMI a value of the desired finished amount, i.e., the target amount in a value of total weight, of a custom formulation to blend. The HMI calculates the total weight of each of the base material components required to create the target amount. The pressure actuator applies downward pressure on the movable puck which pushes the base material through a proportional pressure responsive dispense valve that opens and closes in a rolling manner into a receiving container residing on a scale. As the base material is expelled through the valve, the base material is sensed by a sensor which, along with the scale, sends feedback information to the HMI to increase, decrease or discontinue the pressure being applied to the puck in the material container by the pressure actuator to provide the calculated amount. If the amount of base material expelled does not equal the calculated amount the HMI recalculates the amount of base material required (the "recalculated amount"), recalculates the amount of pressure required of the pressure actuator to attain the recalculated amount, and sends a signal to the pressure actuator to expel the recalculated amount of base material from the material container. The process of expelling a base amount, receiving feedback from the sensor and the scale, calculating if more base material is required and, if required, recalculating the amount of pressure required of the pressure actuator to attain the total recalculated amount continues until the calculated amount is attained. When the calculated amount is attained the operator removes the material container and inserts the next material container required of the formulation, if another is required, into a position under the pressure actuator and repeats the process until the calculated amount of each base material components of the required formulation have been dispensed into the receiving container.

Still another exemplary embodiment of the dispenser holds a single container within resides a single base material which, if required of a desired formulation, in some calculated proportion, is used. Each container is manually positioned by the operator under a pressure actuator. The dispenser may also include an HMI 66 and a scale 68. In this method of use, the operator inputs into the HMI a target amount of the desired finished amount of a custom formulation to blend. The HMI calculates the total weight of each of the base material components required to create the target amount. The operator then positions a container to the dispense position which is the area under a pressure actuator. The pressure actuator is manually activated by the operator to apply downward pressure on the movable puck which pushes the base material through a proportional pressure responsive dispense valve that opens and closes in a rolling manner into a receiving container residing on a scale. As the base material is expelled through the dispense valve and falls into the receiving container the base material is weighed by the scale and the operator may increase, decrease or discontinue the pressure being manually applied to the puck in the material container by the pressure actuator to provide the calculated amount. When the operator discontinues applying pressure to the pressure actuator the dispense valve effectively stops expelling the base component from the material container. The operator then reads the scale value and determines if more base material is required to reach the calculated amount. The operator repeats the above steps until the calculated amount required of the formulation is attained. When the calculated amount is attained the operator positions the next material container required of the formulation, if another is required, into a position under the pressure actuator and repeats the process until the calculated amount of each base material components of the required formulation have been dispensed into the receiving container.

The methods of dispensing custom formulations described herein provide a more cost effective means of creating custom formulations in a timelier manner. The methods also reduce operator handling due to the fact that the operator doesn't need to scoop the paste-type ink from a bucket. As known, the operator may need to physically scoop fractional amounts of ink when adjusting the quantity of ink in the formulation container to arrive at the target weight. With the invention, the bag and containers described herein, with their pressure-sensitive proportional valve attached, cleanly cuts the ink and does not requiring operator handling. Additionally, an operator can minimize the wasted material through accurate operation of the present invention. Residual material waste is limited to the amount of material remaining in the spent bag or container. Also, shipping and storage costs are decreased with the present invention due to bag light weight and compact empty state, saving in both shipping weight costs and required facility storage space for both filled and empty containers. Further, the cubic inches required for disposal of a spent bag is decreased with the current invention and is significantly smaller than any of the current material containers used. Still further, with respect to the material bags, the bag uses $1/12^{th}$ the amount of plastic in its construction as compared to a typical plastic bucket handling a similar amount of material. Using the bag as a storage and dispensing container there will be less of an impact on the environment at disposal.

What is claimed is:

1. A material dispenser comprising:

at least one material container containing material, the container including a dispense valve for permitting the discharge of material from the container;

a computer which controls the discharge of material;

a sensor positioned external to the container and external to the discharged material for detecting the material exiting the dispense valve of the container, the sensor providing feedback regarding the presence of the discharged material to the computer, and a scale for detecting the amount of material discharged from the container, the scale providing feedback regarding the amount of material discharged to the computer, wherein the computer controls the pulsing of additional material based on the feedback from both the sensor and the scale until a targeted amount of material has been discharged from the container.

2. The material dispenser of claim 1 further comprising a plurality of material containers each containing material, the plurality of containers positioned on a turntable, each container including an opening that permits the discharge of material from the container.

3. The material dispenser of claim 1 further comprising a material reservoir for receiving the material discharged from the at least one container; the material reservoir positioned on the scale.

4. The material dispenser of claim 3 further comprising a human/machine interface.

5. The material dispenser of claim 1 further comprising a pressure exerting means selected from the group consisting of an actuator, puck, plate or air.

6. The material dispenser of claim 5 wherein the sensor detects the discharge of material from the container and signals the computer to control the pressure exerting means to exert a pressure on the material for a predetermined amount of time.

7. The material dispenser of claim 6 wherein the container is a bag.

8. The material dispenser of claim 7 wherein the bag may include a valve and wherein the bag is made from a flexible material selected from the group consisting of urethane, vinyl laminated fabric, chloroprene, viscoelastic fabric, buna-N, cloth inserted rubber, polytetraflouroethane, elastomeric rubber, polypropylene, flouroelastomers, rubber, hyplon, polyethylene, neoprene, polyvinylchloride, nitrile, polyolefin films, nylon, prismatic films, lycra, and polyurethane.

9. The material dispenser of claim 6 wherein the container is a tube.

10. The material dispenser of claim 6 wherein the feedback provided by the sensor and scale allow the computer to calculate the amount of additional material to be dispensed from the container, and to recalculate the amount of pressure and time exerted by the pressure exerting means until the targeted amount of material has been obtained.

11. The material dispenser of claim 6 wherein the valve is located at an end of the container and is in operative communication with the container.

12. The material dispenser of claim 11 wherein the sensor is either a video or beam-type sensor.

13. The material dispenser of claim 11 wherein the material is ink.

14. The material dispenser of claim 11 wherein the material is a component in a formulation.

15. The material dispenser of claim 1 wherein the container defines a first and second end, the dispense valve located at the first end, and wherein the container includes a moveable member that is movable within the container, and wherein the moveable member defines an outer edge and wherein at least one seal extends uniformly outward from the outer edge to an inner wall of the container throughout the full extent of motion of the moveable member during dispensing of the material.

16. The material dispenser of claim 15 wherein the dispense valve is a pressure responsive valve.

17. The material container assembly of claim 16 wherein the dispense valve defines a valve head, and wherein the valve head further defines a cross-slit and at least one flap.

18. A method of dispensing material, comprising the steps of:

providing at least one material container, the container including a dispense valve that permits the discharge of material from the container, providing an apparatus to start and stop the discharge of material from the container, providing a computer to control the amount of discharged material, sensing the material exiting the dispense valve of the container, the sensing being performed external to the discharged material, weighing the discharged material, and in response to the sensing and weighing of material, providing feedback regarding the sensing and weighing of material to the computer, wherein the computer determines whether a targeted weight has been reached, and if the targeted weight has not been reached, pulsing additional material from the container based on the feedback provided to the computer.

19. The method of dispensing of claim 18 further comprising the step of processing the sensed and weighed material by the computer.

20. The method of dispensing of claim 18 further comprising the step of sensing the discharge of a small amount of material discharged from the container and providing feedback to the computer that the small amount of material has been sensed.

21. The method of dispensing of claim 20 further comprising weighing the small amount of material discharged and providing feedback to the computer.

22. The method of dispensing of claim 21 wherein the computer recalculates the amount of material required to reach the targeted amount.

23. The method of dispensing of claim 22 further comprising the step of signaling a pressure exerting means to expel the recalculated amount of material from the container.

24. The method of claim 23 wherein the pressure exerting means is a movable member or air.

25. The method of claim 24 wherein the movable member is either a plate, puck or actuator.

* * * * *